US006869907B2

(12) United States Patent
Suzuki

(10) Patent No.: US 6,869,907 B2
(45) Date of Patent: Mar. 22, 2005

(54) COLOR-IMAGE-FORMING MEDIUM

(75) Inventor: Minoru Suzuki, Toichigi (JP)

(73) Assignee: PENTAX Corporation, Tokyo (JP)

( * ) Notice: Subject to any disclaimer, the term of this patent is extended or adjusted under 35 U.S.C. 154(b) by 414 days.

(21) Appl. No.: 09/840,044

(22) Filed: Apr. 24, 2001

(65) Prior Publication Data

US 2001/0053746 A1 Dec. 20, 2001

(30) Foreign Application Priority Data

May 2, 2000 (JP) ..... P2000-133773
Mar. 30, 2001 (JP) ..... P2001-099132
Apr. 3, 2001 (JP) ..... P2001-104428

(51) Int. Cl.[7] ..... B41M 5/30
(52) U.S. Cl. ..... 503/204; 503/215
(58) Field of Search ..... 503/204, 215

(56) References Cited

U.S. PATENT DOCUMENTS

| | | | | |
|---|---|---|---|---|
| 4,444,833 | A | 4/1984 | Moriguchi et al. | 503/204 |
| 4,865,939 | A | 9/1989 | Usami et al. | 430/138 |
| 5,104,767 | A | 4/1992 | Nakamura | 430/168 |
| 5,258,350 | A | 11/1993 | Inoue et al. | 503/204 |
| 5,501,946 | A | 3/1996 | Takagi et al. | 430/573 |
| 6,106,173 | A | 8/2000 | Suzuki et al. | 400/120.02 |
| 6,109,800 | A | 8/2000 | Suzuki et al. | 400/120.02 |
| 6,139,914 | A | 10/2000 | Suzuki et al. | 427/213.3 |
| 6,161,971 | A | 12/2000 | Suzuki et al. | 400/120.01 |
| 6,259,464 | B1 | 7/2001 | Suzuki et al. | 347/172 |

FOREIGN PATENT DOCUMENTS

| | | |
|---|---|---|
| JP | 57150600 | 9/1982 |
| JP | 58-33492 | 2/1983 |
| JP | 58-82785 | 5/1983 |
| JP | 61137787 | 6/1986 |
| JP | 4-292985 | 10/1992 |
| JP | 6-51422 | 2/1994 |
| JP | 8-224962 | 9/1996 |
| JP | 8-282115 | 10/1996 |
| JP | 9-76634 | 3/1997 |

OTHER PUBLICATIONS

English Language Abstract of JP 61–137787.
English Language Abstract of JP 57–150600.
English Language Abstract of JP 6–51422.
English Language Abstract of JP 58–82785.
English Language Abstract of JP 58–33492.

*Primary Examiner*—B. Hamilton Hess
(74) *Attorney, Agent, or Firm*—Greenblum & Bernstein, P.L.C.

(57) ABSTRACT

In a color image-forming medium, a substrate is coated with a color-developing layer which is composed of at least one kind of heat-sensitive color-developing component, and a plurality of pressure-sensitive microcapsules. Each of the pressure-sensitive microcapsules is filled with a dye exhibiting a first single-color, and features a pressure/temperature characteristic to be broken when being subjected to a predetermined pressure within a first temperature range. The heat-sensitive color-developing component features a thermal color-developing characteristic to develop a second single color within a second temperature range defined by a first critical temperature and a second temperature. The first critical temperature is in the first temperature range, and the second critical temperature exceeds an upper limit temperature of the first temperature range.

22 Claims, 18 Drawing Sheets

COLOR-IMAGE-FORMING MEDIUM

BACKGROUND OF THE INVENTION

1. Field of the Invention

The present invention relates to a color-image-forming medium which is constituted such that a color image is formed thereon with at least two colors, and relates to a pressure/heat-sensitive color-developing medium advantageously utilized in such a color-image-forming medium.

2. Description of the Related Art

As a conventional type of color image-forming medium, there is known a heat-sensitive multi-color-developing sheet, which is constituted such that more than two colors can be developed. In general, such a heat-sensitive multi-color-developing sheet comprises a sheet of paper coated with a heat-sensitive color-developing layer containing at least two kinds of leuco-pigment components and a color developer component. As is well known, a leuco-pigment per se exhibits no color. Namely, usually, the leuco-pigment exhibits milky-white or transparency, and reacts with the color developer, to thereby produce a given single-color (e.g. magenta, cyan or yellow). The leuco-pigment components, contained in the color-developing layer, feature different color-developing temperatures such that different colors can be obtained due to the respective color-developing temperatures.

For example, when the leuco-pigment components, contained in the color-developing layer, are composed of respective magenta- and cyan-developing leuco-pigments featuring low and high color-developing temperatures, respective magenta and blue, can be obtained due to the low and high color-developing temperatures thereof. In particular, when a first temperature between the low magenta-developing temperature and the high cyan-developing temperature is locally exerted on the color-developing layer, only the magenta-developing leuco-pigment component reacts with the color developer component so that magenta is developed at the localized area where the first temperature is exerted on. Also, when a second temperature higher than the high cyan-developing temperature is locally exerted on the color-developing layer, both the magenta- and cyan-developing leuco-pigment components react with the color developer component so that blue is developed as a mixture of magenta and cyan at the localized area where the second temperature is exerted on.

As is apparent from the aforesaid example, it is impossible to independently develop cyan by the cyan-developing leuco-pigment component. Thus, the conventional multi-color image-forming medium is inferior in efficiency of color development, because it is possible to independently develop only a leuco-pigment component exhibiting the lowest color-developing temperature.

Also, in the aforesaid example, a temperature difference between the low magenta-developing temperature and the high cyan-developing temperature must be sufficiently high, before a development of pure magenta can be obtained on the color-developing layer. Namely, if the temperature difference between the magenta-developing temperature and the cyan-developing temperatures is too low, a part of the cyan-developing leuco-pigment component may undesirably react with the color developer component at the first temperature for the development of magenta, resulting in the development of magenta with a cyan tint.

Further, in the aforesaid example, the low magenta-developing temperature must be more than 100° C., before erroneous and accidental development of magenta can be prevented, because the color-developing layer may be frequently exposed to, for example, a temperature in a range of 80 to 100° C. under an ordinary circumstance. Thus, if the low magenta-developing temperature is less than 100° C., the erroneous and accidental development of magenta may often occur.

Accordingly, in the conventional multi-color image-forming medium, a combination of different leuco-pigments, which can be utilized to form a heat-sensitive color-developing layer, is severely and considerably restricted, because respective various leuco-pigments feature inherent color-developing temperatures. In the aforesaid example, if one is optionally selected from among various magenta-developing leuco-pigments, it cannot be ensured whether there is a cyan-developing leuco-pigment which can be combined with the selected magenta-developing leuco-pigment.

Conventionally, although a user frequently requires that only one single-color is developed with a desired tone in a multi-color image-forming medium, it is virtually impossible to even obtain the development of only the single-color with the desired tone, because of the severe and considerable restriction of the combination of different leuco-pigments.

Further, the conventional color image-forming medium is inferior in thermal energy efficiency for the development of color, because the lowest color-developing temperature must be more than 100° C., before erroneous and accidental development of color can be prevented, and because the temperature difference between the low color-developing temperature and the high color-developing temperature must be sufficiently large.

Furthermore, in the conventional multi-color image-forming medium, of course, it is impossible to utilize a pigment type other than a leuco-pigment.

SUMMARY OF THE INVENTION

Therefore, an object of the present invention is to provide a color image-forming medium which is constituted such that development of only one single-color with a desired tone can be ensured.

Another object of the present invention is to provide a color image-forming medium of the aforesaid type, which features superior efficiency of color developments and superior thermal energy efficiency.

Yet another object of the present invention is to provide a color-developing medium, utilized in the color image-developing medium, which is composed of a suitable sheet-like substrate and a pressure/heat-sensitive color developer layer formed on the suitable substrate such that pressure-sensitive microcapsules contained in the pressure/heat-sensitive color developer are not squashed and broken at more than a critical heating temperature. In accordance with a first aspect of the present invention, there is provided a color image-forming medium comprising a substrate, and a color-developing layer coated on the substrate. The color-developing layer is composed of at least one kind of heat-sensitive color-developing component, and a plurality of pressure-sensitive microcapsules uniformly distributed therein. Each of the pressure-sensitive microcapsules is filled with a dye exhibiting a first single-color, and features a pressure/temperature characteristic to be broken when being subjected to a predetermined pressure within a first temperature range. The heat-sensitive color-developing component features a thermal color-developing characteristic to develop a second single color within a second temperature range defined by a first critical temperature and a second temperature. The first critical temperature is in the first temperature range, and the second critical temperature exceeds an upper limit temperature of the first temperature range.

According to the aforesaid color image-forming medium, a temperature range between the first critical temperature of the second temperature range and the upper limit temperature of the first temperature range is defined as a color developing range in which both the first single color and the second single color are developed, and a temperature range between the upper limit temperature of the first temperature range and the second critical temperature of the second temperature range is defined as a color developing range in which only the second single color is developed.

An extent of the first temperature range may be regulated by varying at least one parameter selected from the group consisting of a thickness of the color-developing layer, an amount of filler contained in the color-developing layer, an average diameter of the pressure-sensitive microcapsules, a material of the substrate, a shell wall strength of the pressure-sensitive microcapsules and a surface roughness of the substrate.

Preferably, a lower limit temperature of the first temperature range is set as a temperature of less than 100° C.

The color developing layer may be further composed of another kind of heat-sensitive color-developing component featuring a thermal color-developing characteristic to develop a third single color within a third temperature range more than the second critical temperature.

Each of the heat-sensitive color-developing components may comprise a leuco-pigment, and the color developing layer is composed of a color developer component for the leuco-pigment.

The first temperature may be defined as a critical color-developing temperature of the leuco-pigment exhibiting the thermal color developing characteristic defined by the second temperature range, and the second temperature may be defined as a critical color-developing temperature of the leuco-pigment exhibiting the thermal color developing characteristic defined by the third temperature range. The leuco-pigment, exhibiting the thermal color developing characteristic defined by the third temperature range, may comprise a black-developing leuco-pigment.

When the dye, encapsulated in the pressure-sensitive microcapsules, is based on a leuco-pigment, the color developer component is thermally fused when being subjected to at least a lower limit temperature of the first temperature range.

The color developing layer may be formed as a double-layer structure including a pressure/heat-sensitive color-developing layer containing the pressure-sensitive microcapsules and a heat-sensitive color-developing layer composed of the heat-sensitive color developing component. When the dye, encapsulated in the pressure-sensitive microcapsules, is based on a leuco-pigment, the pressure/heat-sensitive color-developing layer may be composed of a color developer component for the leuco-pigment. In this case, the color developer component is thermally fused when being subjected to at least a lower limit temperature of the first temperature range.

The pressure/heat-sensitive color developing layer may be further composed of another kind of heat-sensitive color-developing component featuring a thermal color-developing characteristic to develop a third single color within a third temperature range more than the second critical temperature.

When each of the heat-sensitive color-developing components comprises a leuco-pigment, each of the pressure/heat-sensitive color developing layer and the heat-sensitive color developing layer may be composed of a color developer component for the leuco-pigment. In this case, the first temperature is defined as a critical color-developing temperature of the leuco-pigment contained in the heat-sensitive color-developing layer, and the second temperature is defined as a critical color-developing temperature of the leuco-pigment contained in the pressure/heat-sensitive color-developing layer. Preferably, the leuco-pigment contained the pressure/heat-sensitive color-developing layer comprises a black-developing leuco-pigment.

In accordance with a second aspect of the present invention, there is provided a color developing medium comprising a substrate, and a pressure/heat-sensitive color-developing layer coated on the substrate. The pressure/heat-sensitive color-developing layer is formed as a binder layer containing a plurality of pressure-sensitive microcapsules uniformly distributed therein. Each of the pressure-sensitive microcapsules is filled with a dye exhibiting a given single-color, and features a pressure/temperature characteristic to be broken when being subjected to a predetermined pressure within a predetermined temperature range. An extent of the temperature range is regulated by varying at least one parameter selected from the group consisting of a thickness of the pressure/heat-sensitive color-developing layer, an amount of filler contained in the pressure/heat-sensitive color-developing layer, an average diameter of the pressure-sensitive microcapsules, a material of the substrate, a shell wall strength of the pressure-sensitive microcapsules and a surface roughness of the substrate.

In the second aspect of the present invention, when the dye, encapsulated in the pressure-sensitive microcapsules, is based on a leuco-pigment, the binder layer may formed as a color developer layer composed of a color developer component for the leuco-pigment. In this case, the color developer component is thermally fused when being subjected to at least a lower limit temperature of the temperature range.

BRIEF DESCRIPTION OF THE DRAWINGS

The object and other objects of the present invention will be better understood from the following description and with reference to the accompanying drawings, in which.

DESCRIPTION OF THE PREFERRED EMBODIMENTS

Figure 1:
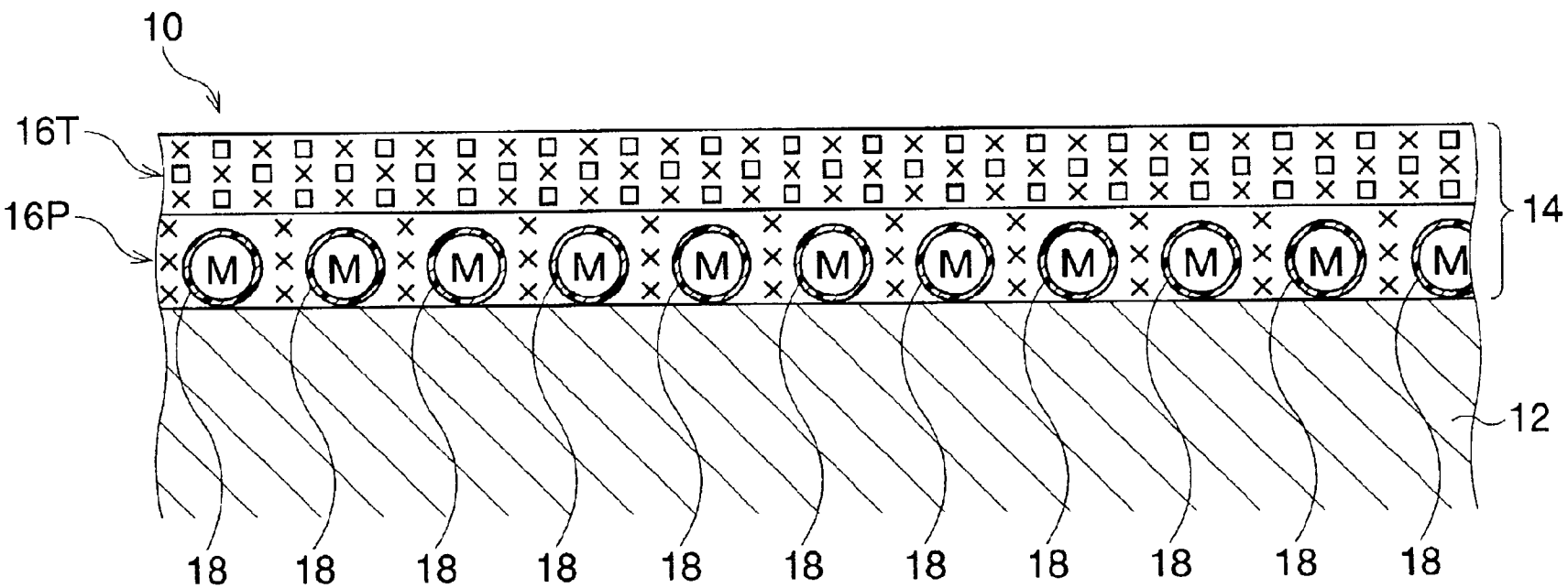
FIG. 1 is a schematic cross-sectional view showing a first embodiment of a color image-forming medium, according to the present invention.

FIG. 1 schematically shows a first embodiment of a color image-forming medium, generally indicated by reference numeral 10, according to the present invention. The color image-forming medium 10 comprises a suitable sheet-like substrate 12 formed as a sheet of polyethylene terephthalate (PET), and a color-developing layer 14 coated thereon. The PET sheet 12 has a thickness of 0.188 mm. The color-developing layer 14 is formed as a double-layer structure including a pressure/heat-sensitive color-developing layer 16P coated on the PET sheet 12, and a heat-sensitive color-developing layer 16T coated thereon.

The pressure/heat-sensitive color-developing layer 16P is formed as a color developer layer mainly composed of a color developer component for a leuco-pigment and containing a plurality of pressure-sensitive microcapsules 18 uniformly distributed therein. In FIG. 1, the color developer component is represented by symbols "×". For the color developer component "×", K-5 may be utilized. Note, K-5 is available from ASAHI DENKA KOGYO K.K., and exhibits a melting point of about 145° C. Although not shown in FIG. 1, the color-developing layer 16P contains a suitable amount of acetoacetic anilide which serves as a sensitizer for regulating the melting point of the color developer component "×".

The pressure-sensitive microcapsules 18 are filled with, for example, a magenta ink or dye exhibiting a given tone which is required by a user. In this embodiment, the magenta dye is composed of a transparent liquid vehicle, and a magenta-developing leuco-pigment dispersed or dissolved in the vehicle. For the liquid vehicle, a transparent oil, for example, 2,7-di-isopropyl naphthalene, exhibiting a boiling point of about 300° C., may be utilized. Note, 2,7-di-isopropyl naphthalene is available as KMC-113 from R ütgers Kureha Solvents (RKS) GmbH. For the magenta-developing leuco-pigment, Red-3 is utilized. Red-3 is available from YAMAMOTO KASEI K.K., and exhibits a melting point of about 210° C., substantially equivalent to a color-developing temperature thereof. In FIG. 1, the magenta dye, encapsulated in each pressure-sensitive microcapsule 18, is represented by the first capital letter "M" of magenta.

A shell wall of each pressure-sensitive microcapsule 18 is formed of a melamine resin exhibiting transparency. The pressure-sensitive microcapsules 18 have an average diameter of about 5 to 6 μm, and the shell wall of each microcapsule 18 has a thickness such that each microcapsule 18 is squashed and broken when being subjected to a pressure of higher than about 0.35 MPa, with a shearing force. Note, the melamine resin may exhibit a heat-resistance temperature of about 300° C.

This type of microcapsule can be produced by a suitable polymerization method, such as an in-situ polymerization method. In particular, to produce the microcapsules 18, the following solutions (A), (B) and (C) are prepared:

| | | |
|---|---|---|
| (A) | magenta dye solution: | |
| | KMC-113 (2,7-di-isopropyl naphthalene) | 100 g |
| | Red-3 | 3 g |
| (B) | protective colloid aqueous solution: | |
| | partly sodium-sulfonated polyvinyl benzenesulfonic acid | 5 g |
| | purified water | 95 g |
| (C) | melamine-formalin prepolymer aqueous solution: | |
| | melamine | 14 g |
| | formalin | 36 g |
| | purified water | 50 g |

The formalin for use in the preparation of the melamine-formalin prepolymer aqueous solution (C) is a 37 wt. % formaldehyde aqueous solution, which is regulated to pH9 with a 2 wt. % sodium hydroxide aqueous solution. A mixture of 14 g of the melamine and 36 g of the 37 wt. % formaldehyde solution is prepared, and is heated to a temperature of 70° C. After the melamine is completely dissolved, 50 g of the purified water is added, and the resultant mixture is stirred, thereby producing the solution (C).

The solutions (A) and (B) are mixed, and the mixture is agitated with a homogenizer, thereby producing an O/W emulsion (D). A rotational speed of the homogenizer and an agitating time by the homogenizer are adjusted so that the magenta dye solution (A) is suspended in water as drops having an average diameter of about 4.5 μm.

The solution (C) is added to and mixed with the emulsion (D), and the mixture is slowly agitated at a temperature of 30° C. During the agitation, a suitable amount of 20 wt. % acetic acid aqueous solution is added to the mixture to control the pH in a range of pH3 to pH6. Then, the mixture is heated to a temperature of 60° C. for carrying out a condensation polymerization reaction while agitating the mixture for about one hour, resulting in the production of microcapsules 18 having an average diameter of about 5 to 6 μm.

The produced microcapsules 18 feature a thickness of the shell wall such that each microcapsule 18 is squashed and broken when being subjected to the pressure of higher than about 0.35 MPa, with the shearing force. The thickness of the shell wall mainly depends on the amount of melamine contained in the melamine-formalin prepolymer aqueous solution (C): The larger the amount of melamine, the thicker the shell wall.

The heat-sensitive color-developing layer 16T is composed of a cyan-developing leuco-pigment component represented by symbols "□", and a color developer component represented by symbols "×". In the first embodiment, for the cyan-developing leuco-pigment component "□", Blue-220 is utilized. Note, Blue-220 is available from YAMADA CHEMICAL K.K., and exhibits a melting point of about 147° C., substantially equivalent to a color-developing temperature thereof. For the color developer component "×", K-5 is utilized. Although not shown in FIG. 1, the heat-sensitive color-developing layer 16T also contains a suitable amount of acetoacetic anilide which serves as a sensitizer for regulating the color-developing temperature of the cyan-developing leuco-pigment component "□" and the melting point of the color developer component "×".

To produce the pressure/heat-sensitive color-developing layer 16P, an aqueous compound A is prepared, composed as shown in the following table:

| COMPOSITIONS | PARTS BY WEIGHT |
|---|---|
| (1) 25 wt. % microcapsule aqueous dispersion | 1.0 |
| (2) 20 wt. % K-5 aqueous dispersion | 1.0 |
| (3) 16 wt. % acetoacetic anilide aqueous dispersion | 0.5 |
| (4) 20 wt. % PVA aqueous solution | 0.5 |

Herein:

The composition (1) is prepared by mixing 25 wt. % of the microcapsules 18 with purified water;

The composition (2) is prepared by mixing 20 wt. % of K-5 (color developer) with purified water, K-5 being a powder having an average diameter of less than 1 μm;

The composition (3) is prepared by mixing 16 wt. % of acetoacetic anilide (sensitizer) with purified water, this sensitizer being also a powder having an average diameter of less than 1 μm; and The composition (4) is prepared by dissolving 20 wt. % of polyvinyl alcohol (PVA) in purified water, PVA featuring a polymerization degree of 500.

The PET sheet 12 is coated with the aqueous compound A at about 1 to 3 g per square meter, using a No.3/Mayer-Bar, and then the coated layer is allowed to dry naturally, resulting in production of the pressure/heat-sensitive color-developing layer 16P.

Note, the "Mayer-Bar" is phonetically translated, and is well known as a bar for coating a surface with a liquefied material. A number is given to each Mayer-Bar, the greater the number, the thicker the coating.

Since the color-developing layer 16P contains acetoacetic anilide (sensitizer), the melting point of the color developer component (K-5) is lowered from 145° C. to about 90° C. The content of acetoacetic anilide may be suitably varied to regulate the meting point of the color developer component "×". Note, polyvinyl alcohol (PVA) serves as a binder for adhering the color developer component "×" and the microcapsules 18 to each other, and for adhering the color-developing layer 16P to the PET sheet 12.

To produce the heat-sensitive color-developing layer 16T, an aqueous compound B is prepared, composed as shown in the following table:

| COMPOSITIONS | PARTS BY WEIGHT |
|---|---|
| (1) 17 wt. % Blue-220 aqueous dispersion | 1.0 |
| (2) 20 wt. % K-5 aqueous dispersion | 1.0 |
| (3) 16 wt. % stearic acid amide aqueous dispersion | 0.5 |
| (4) 20 wt. % PVA aqueous solution | 0.5 |

Herein:

The composition (1) is prepared by mixing 17 wt. % of Blue-220 (cyan-developing leuco-pigment) with purified water, Blue-220 being a powder having an average diameter of less than 1 μm;

The composition (2) is prepared by mixing 20 wt. % of K-5 (color developer) with purified water;

The composition (3) is prepared by mixing 16 wt. % of stearic acid amide (sensitizer) with purified water, this sensitizer being also a powder having an average diameter of less than 1 μm; and The composition (4) is prepared by dissolving 20 wt. % of polyvinyl alcohol (PVA) in purified water, PVA featuring a polymerization degree of 500.

The heat-sensitive color-developing layer 16T is coated with the aqueous compound B at about 1 to 3 g per square meter, using a No.3/Mayer-Bar, and then the coated layer is allowed to dry naturally, resulting in production of the heat-sensitive color-developing layer 16T, and therefore, the color image-forming medium 10.

Since the color-developing layer 16T contains stearic acid amide (sensitizer), the melting point of the color developer component (K-5) is lowered from 145° C. to about 90° C., and the color-developing temperature of the cyan-developing leuco-pigment component (Blue-220) is lowered to about 105° C.

Figure 2:
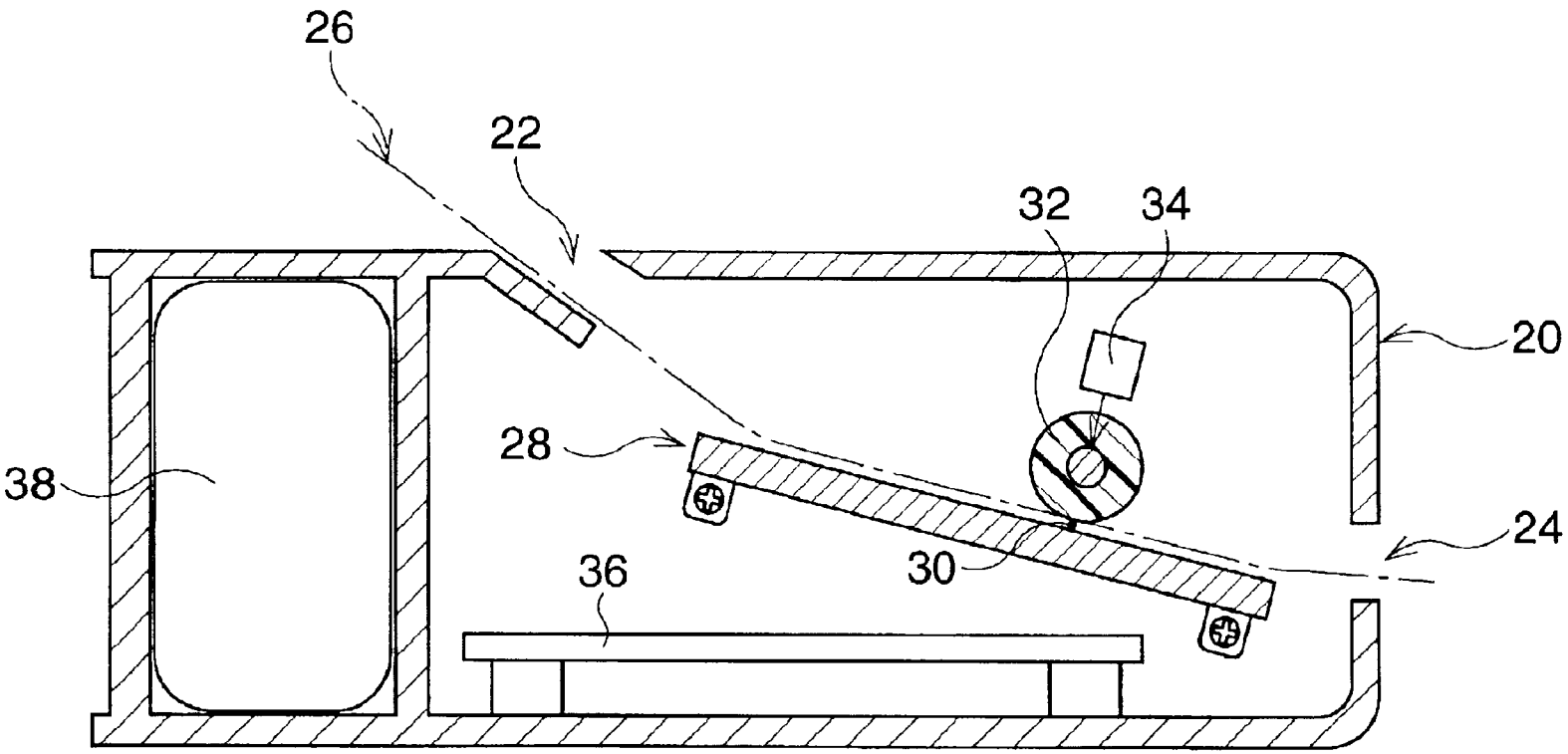
FIG. 2 is a schematic cross-sectional view of a line type printer for forming a color image on the image-forming medium shown in FIG. 1.

FIG. 2 schematically shows a thermal printer, which is constituted as a line printer to form a color image on the image-forming medium 10. Using this thermal printer, the formation of color image can be performed with three colors; magenta, blue and cyan, as stated in detail hereinafter.

The printer comprises a rectangular parallelepiped housing 20 having an entrance opening 22 and an exit opening 24 formed in a top wall and a side wall of the housing 20, respectively. The image-forming medium 10 is introduced into the housing 20 through the entrance opening 22, and is then discharged from the exit opening 24 after the formation of a color image on the image-forming medium 10. Note, in FIG. 2, a path 26 for movement of the image-forming medium 10 is represented by a single-chained line.

A guide plate 28 is provided in the housing 20 to define a part of the path 26 for the movement of the image-forming medium 10, and a thermal printer head 30 is securely attached to a surface of the guide plate 28. The thermal printing head 30 is formed as a line thermal printing head perpendicularly extended with respect to a direction of the movement of the image-forming medium 10.

Figure 3:
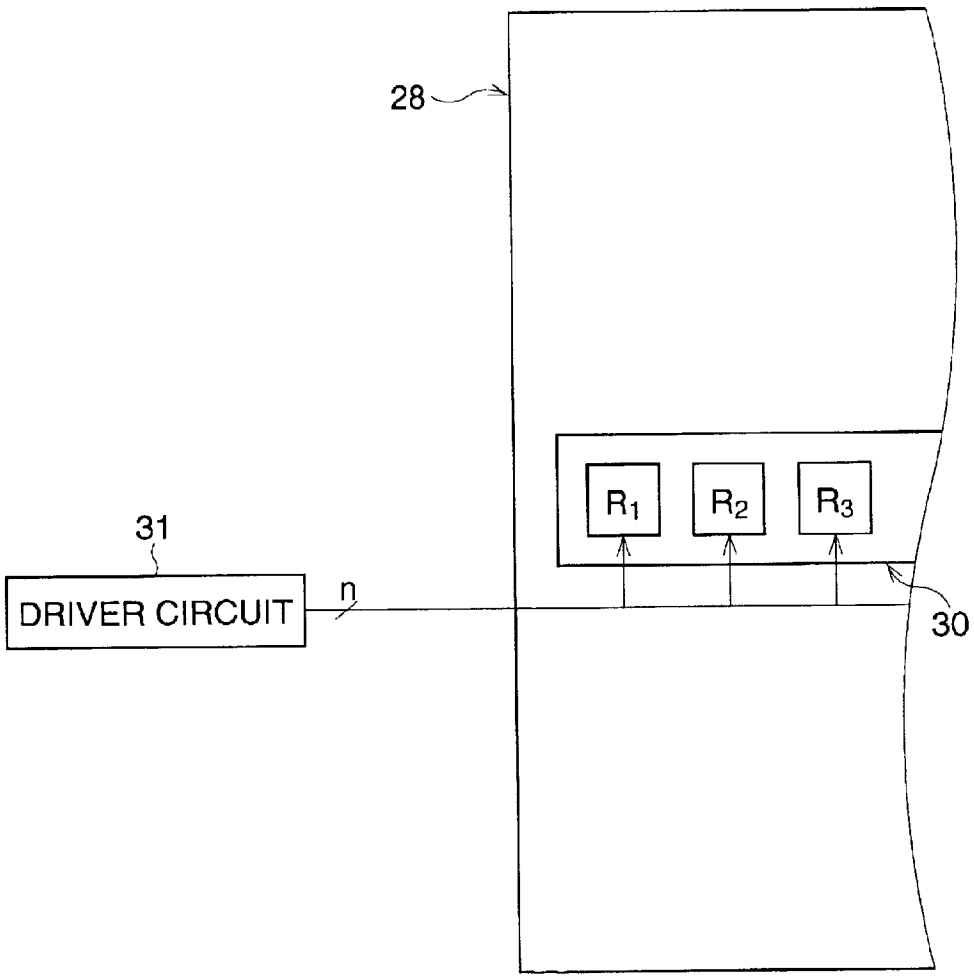
FIG. 3 is a partial schematic block diagram showing a thermal printing head and a driver circuit therefor, incorporated in the printer shown in FIG. 3.

As shown in FIG. 3, the thermal printing head 30 includes a plurality of heater elements or electric resistance elements $R_1$ to $R_n$, only the elements $R_1$, $R_1$ and $R_3$ of which are visible in FIG. 3, and the elements $R_1$ to $R_n$ are aligned with each other along a length of the first thermal printing head 30. the resistance elements $R_1$ to $R_n$ are connected to a driver circuit 31, and are selectively energized by the first driver circuit 31 in accordance with a single-line of color pixel signals.

In particular, when any one of the resistance elements $R_1$ to $R_n$ is energized in accordance with a magenta pixel signal, the resistance element concerned is heated to a temperature of 90° C. When any one of the resistance elements $R_1$ to $R_n$ is energized in accordance with a blue pixel signal, the element concerned is heated to a temperature of 120° C. When any one of the resistance elements $R_1$ to $R_n$ is energized in accordance with a cyan pixel signal, the element concerned is heated to a temperature of about 180° C.

As shown in FIG. 2, the thermal printing head 30 is associated with a roller platen 34, and the roller platen 34 is formed of a suitable hard rubber material. The roller platen 34 is provided with a spring-biasing unit 36 so as to be elastically pressed against the thermal printing head 30 at a pressure of 1.4 MPa more than the critical breaking-pressure of 0.35 MPa of the pressure-sensitive microcapsules 18.

Note, in FIG. 2, reference 36 indicates a control circuit board for controlling a printing operation of the thermal printer, and reference 38 indicates an electrical main power source for electrically energizing the control circuit board 36 including the driver circuit 31.

During the printing operation, the roller platen 34 is rotated in a counterclockwise direction (FIG. 2) with a given peripheral speed under control of the control circuit board 36, so that the color image-forming medium 10, introduced into the entrance opening 22, moves toward the exit opening 24 along the path 26. Note, the introduction of the image-forming medium 10 is performed such that the color-developing layer 14 is in direct contact with the thermal printing head 30.

While the image-forming medium 10 passes between the thermal printing head 30 and the roller platen 34, the color-developing layer 14 of the image-forming medium 10 is subjected to the pressure of 1.4 MPa with the shearing force from the electric resistance elements ($R_1, \ldots, R_n$) of the thermal printing head 30. Nevertheless, as long as each of the resistance elements is not electrically energized and heated to a temperature of at least 90° C., each resistance element cannot exert the pressure of 1.4 MPa with the shearing force on the microcapsules 18 due to the solid phase of the color-developing layer 14, and thus the microcapsules 18 are prevented from being squashed and broken.

Figure 4:
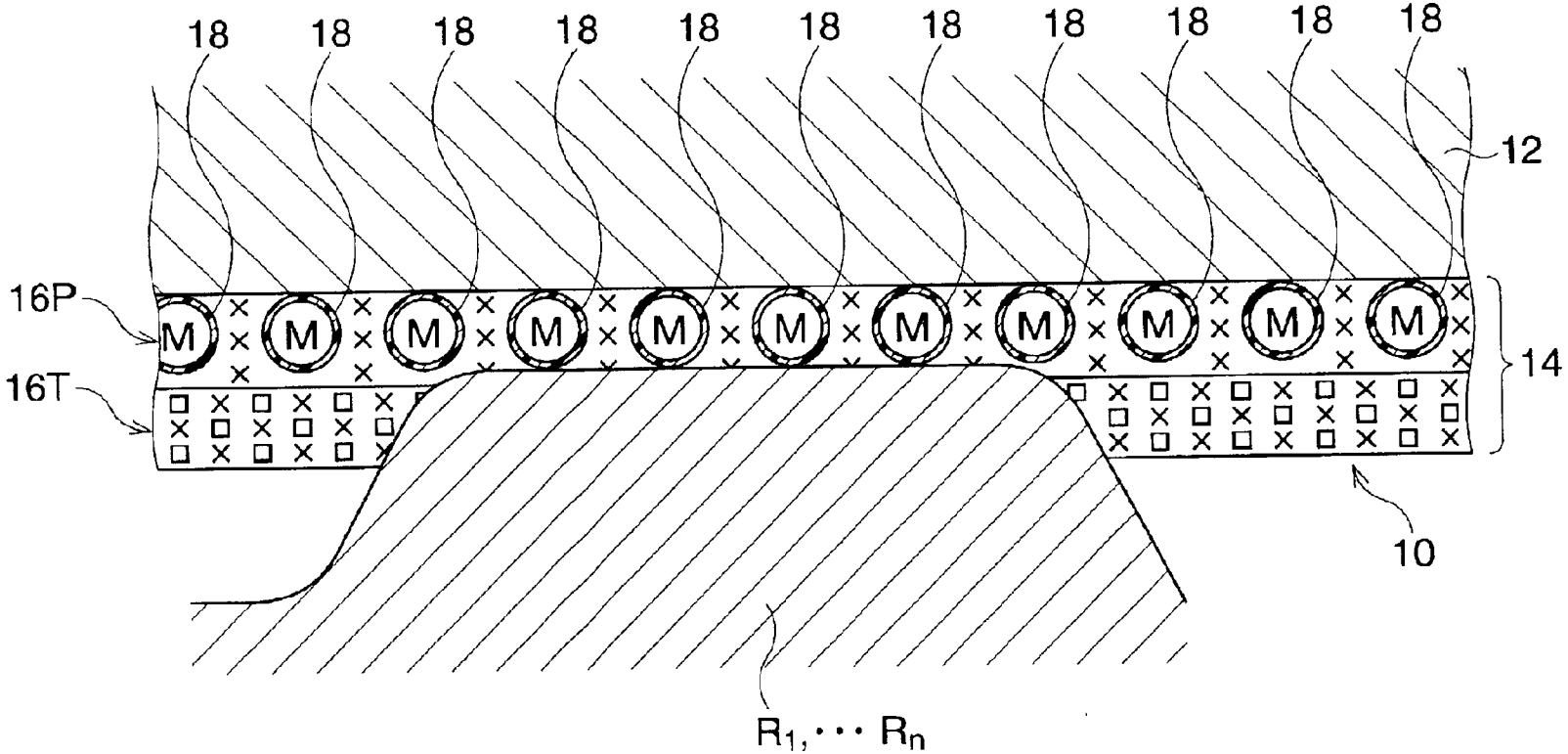
FIG. 4 is a schematic cross-sectional view showing penetration of an electric resistance element of the thermal printing head to thereby develop either a magenta dot, a blue dot or a cyan dot on the image-forming medium shown in FIG. 1.

However, when any one of the resistance elements $R_1$ to $R_n$ is energized in accordance with a color pixel signal, the element concerned is heated to a temperature of at least of 90° C., whereby the color developer component "×" is thermally softened or fused due the existence of the sensitizer (stearic acid amide). Thus, the heated resistance element ($R_1, \ldots, R_n$) penetrates into the color-developing layer 14, as shown in FIG. 4 by way of example. Accordingly, the pressure-sensitive microcapsules 18, included in the penetrated area of the color-developing layer 14, are directly subjected to the pressure 1.4 MPa, with the shearing force, from the heated element ($R_1, \ldots, R_n$) and thus are squashed and broken, resulting in discharge of the magenta dye from the broken microcapsules 18.

When the energization of the element concerned is based on the magenta pixel signal, the heating temperature of the element is 90° C. Thus, a magenta dot is produced on the color-developing layer 14, because only magenta is developed due to the heating temperature of the element being 90° C., less than the color-developing temperature (105° C.) of the cyan-developing leuco-pigment component "□".

Note, when the magenta dye is seeped from a broken microcapsule 18, the magenta-developing leuco-pigment component contained in the magenta dye immediately reacts with the color developer regardless of the color-developing temperature thereof, because the magenta-developing leuco-pigment is dissolved in the transparent oil (KMC-113).

Also, when the energization of the element concerned is based on the blue pixel signal, the heating temperature of the element is 120° C. Thus, a blue dot is produced on the color-developing layer 14, because both magenta and cyan are developed due to the heating temperature of the element being 120° C., more than the color-developing temperature (105° C.) of the cyan-developing leuco-pigment component "□".

Further, when the energization of the element concerned is based on the cyan pixel signal, the element is heated to 180° C. Thus, both magenta and cyan ought to be developed to thereby produce a blue dot on the color-developing layer 14 for the same reason as in the aforesaid case where the energization of the element is based on the blue pixel signal. Nevertheless, it was surprisingly found that the microcapsules 18 were not squashed and broken when the element ($R_1, \ldots, R_n$) was instantaneously heated to the temperature (180° C.), more than a critical temperature, as stated hereinafter. Consequently, a cyan dot is produced on the color-developing layer 14, because only cyan is developed.

Accordingly, using the thermal printer as shown in FIG. 2 and 3, it is possible to record a color image on the image-forming medium 10 by magenta dots, blue dots and cyan dots. Note, a dot size (diameter) of the magenta, blue and cyan dots corresponds to a size of the resistance elements ($R_1, \ldots, R_n$), and may be about 50 to 100 $\mu$m.

The aforesaid admirable phenomenon has been adventitiously found during experiments for investigating color developing characteristics of various color image-forming mediums, which have been carried out by the inventor.

Figure 5:
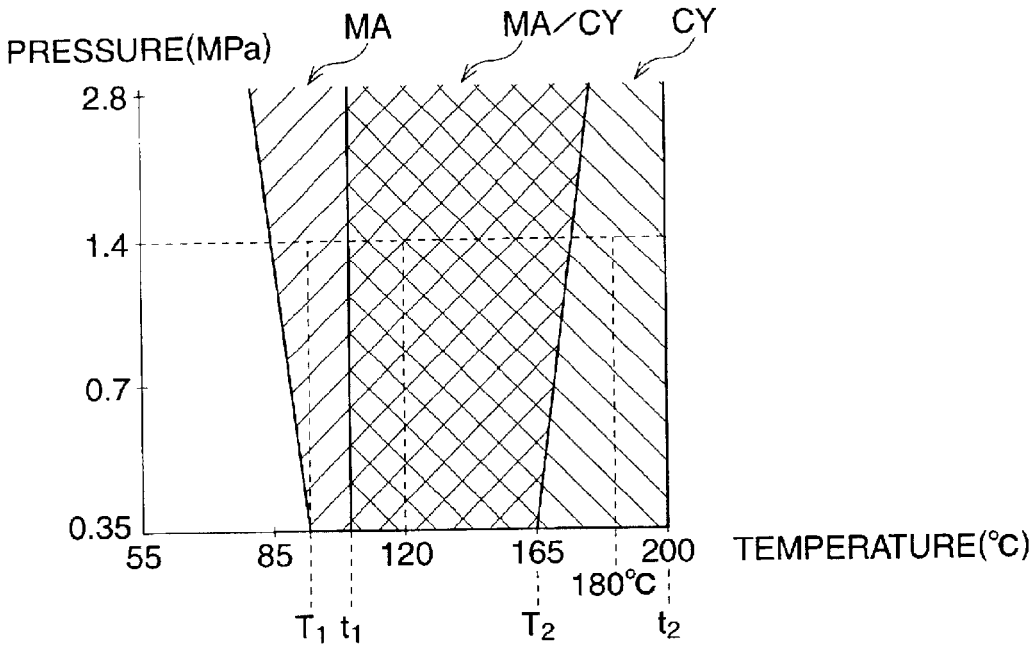
FIG. 5 is a graph illustrating color developing characteristics of the first embodiment shown in FIG. 1.

With reference to FIG. 5, results of an experiment, carried out by the inventor, are shown as a graph. In this experiment, image-forming mediums were produced by way of trial under the same conditions as the first embodiment of the image-forming medium 10, and color developing characteristics were investigated with respect to the trial image-forming mediums (10), using the thermal printer as shown in FIGS. 2 and 3. In the experiment, the pressure, exerted by the resistance elements ($R_1, \ldots, R_n$) on the trial image-forming mediums, was discretely varied in a range of from 0.35 MPa to 2.8 MPa, and the heating temperature of the resistance elements ($R_1, \ldots, R_n$) was discretely varied in a range of from 55° C. to 200° C.

In the graph of FIG. 5, a hatching area, indicated by reference "MA", is a magenta-developing area; a hatching area, indicated by reference "CY" is a cyan-developing area; and a cross-hatching area, overlapped by both the developing areas "MA" and "CY", is a blue-developing area indicated by reference "MA/CY". When the pressure is 0.35 MPa, the magenta-developing area "MA" is defined as a temperature range between critical temperatures $T_1$ and $T_2$; the cyan-developing area "CY" is defined as a temperature range more than a critical temperature of $t_1$; and the blue-developing area "MA/CY" is defined as a temperature range between the critical temperatures $t_1$ and $T_2$. Note, the respective temperatures of $T_1$ and $T_2$ are equivalent to 90° C. and 165° C., and the temperature $t_1$ is equivalent to 105° C. Also, note, a critical temperature of $t_2$, equivalent to 200° C., is conveniently defined as an upper limit of the cyan-developing temperature range.

As is apparent from the graph of FIG. 5, when the pressure is 0.35 MPa, and when the heating temperature of a resistance element ($R_1$, . . . , $R_n$) exceeds the critical temperature $T_2$ (165° C.), the microcapsules 18 are not squashed and broken. Even though the pressure is increased from 0.35 MPa, the critical temperature is insignificantly raised from 165° C. Namely, when the heating temperature of the resistance element ($R_1$, . . . , $R_n$) is more than the critical temperature (165° C.), it is impossible to squash and break the microcapsules 18.

The reason why the microcapsules 18 are not squashed and broken may be assumed as follows:

When the resistance element is heated to the critical temperature (165° C.), a portion of the color-developing layer (14), to which the heated element is applied, is instantaneously fused, due to an increase of the heating-radiation of the heated element, whereby fluidization of the fused material is facilitated, resulting in slippage of the microcapsules 18 from a nip between the PET sheet 12 and the resistance element ($R_1$, . . . , $R_n$) without being squashed and broken. Otherwise, the microcapsules 18 are submerged in the fused material so that the breaking pressure cannot be sufficiently exerted on the submerged microcapsules 18, and thus the microcapsules 18 are not squashing and breaking.

The aforesaid various printing parameters of the thermal printer (FIGS. 2 and 3) are determined on the basis of the color-developing haracteristics shown in the graph of FIG. 5. Namely, the pressure of 1.4 MPa, which is exerted by the resistance elements ($R_1$, . . . , $R_n$) on the image-forming medium 10, is suitably selected from the graph of FIG. 5, and the respective temperatures of 90, 120 and 180° C. are suitably selected from the graph FIG. 5 as the magenta-, blue- and cyan-developing temperatures.

For the purpose of further studying the aforesaid admirable phenomenon, various types of image-forming mediums were produced by way of trial under conditions that differ from the first embodiment of the image-forming medium 10, as below.

In a first type of image-forming medium, a color-developing layer (14) is made thicker in comparison with the first embodiment. Namely, a pressure/heat-sensitive color-developing layer (16P) was formed by coating a PET sheet (12) with the aforesaid aqueous compound A at about 4 to 6 g per square meter, using a No.6/Mayer-Bar, and then a heat-sensitive color developing layer (16T) was formed by coating the pressure/heat-sensitive color-developing layer (16P) with the aforesaid aqueous compound B at about 4 to 6 g per square meter, using a No.6/Mayer-Bar.

With respect to the first type of image-forming medium, color developing characteristics were investigated, using the thermal printer as shown in FIGS. 2 and 3, by carrying out an experiment in the same manner as mentioned above. The results of the experiment is shown in a graph of FIG. 6. Similar to the graph of FIG. 5, in the graph of FIG. 6, respective magenta-, blue- and cyan-developing areas are indicated by references "MA", "MA/CY" and "CY".

Figure 6:
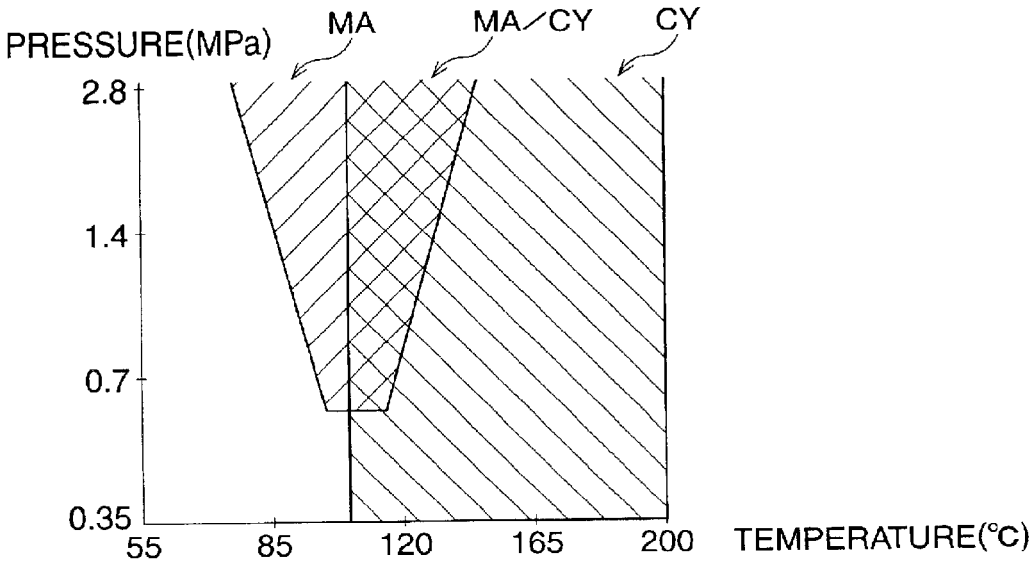
FIG. 6 is a graph illustrating color developing characteristics of the first embodiment shown in FIG. 1, provided that a thickness of a color developing layer of the image-forming medium is varied.

As is apparent from a comparison of the graph of FIG. 6 and the graph of FIG. 5, when the color-developing layer (14) is made thicker, the magenta-developing area "MA" is narrowed. It is assumed that the narrowness of the magenta-developing area "MA" has resulted from the fact that the slippage of the microcapsules (18) from the nip between the PET sheet (12) and the resistance element ($R_1$, . . . , $R_n$) is further facilitated due to the increase of the thickness of the color-developing layer (14). In short, it is possible to regulate an extent of the magenta-developing area "MA" by varying the thickness of the color-developing area (14).

In a second type of image-forming medium, a filler was added to a pressure/heat-sensitive color-developing layer (16P). For the filler, Aerojiru-200 was utilized. Note, Aerojiru-200 is available from JAPAN AEROJIRU K.K., the "AEROJIRU" of which is phonetically translated.

In particular, an additional composition was prepared by mixing 5 wt. % of Aerojiru-200 with purified water, and 2.0 pbw (parts by weight) of the additional composition was added to the foresaid aqueous compound A. Namely, an aqueous compound A', which is essentially identical to the aforesaid aqueous compound A except that 2.0 pbw of the additional composition is further contained, as prepared. The pressure/heat-sensitive color-developing layer (16P) was formed by coating a PET sheet (12) with the aqueous compound A' at about 4 to 6 g per square meter, using a No.6/Mayer-Bar, and then a heat-sensitive color developing layer (16T) was formed by coating the pressure/heat-sensitive color-developing layer (16P) with the aforesaid aqueous compound B at about 4 to 6 g per square meter, using a No.6/Mayer-Bar. In short, the second type of image-forming medium is identical to the first type of image-forming medium (FIG. 6) except that the pressure/heat sensitive color-developing layer (16P) contains the filler (Aerojiru-200).

With respect to the second type of image-forming medium, color developing characteristics were investigated, using the thermal printer as shown in FIGS. 2 and 3, by carrying out an experiment in the same manner as mentioned above. The results of the experiment is shown in a graph of FIG. 7, in which respective magenta-, blue- and cyan-developing areas are also indicated by references "MA", "MA/CY" and "CY".

Figure 7:
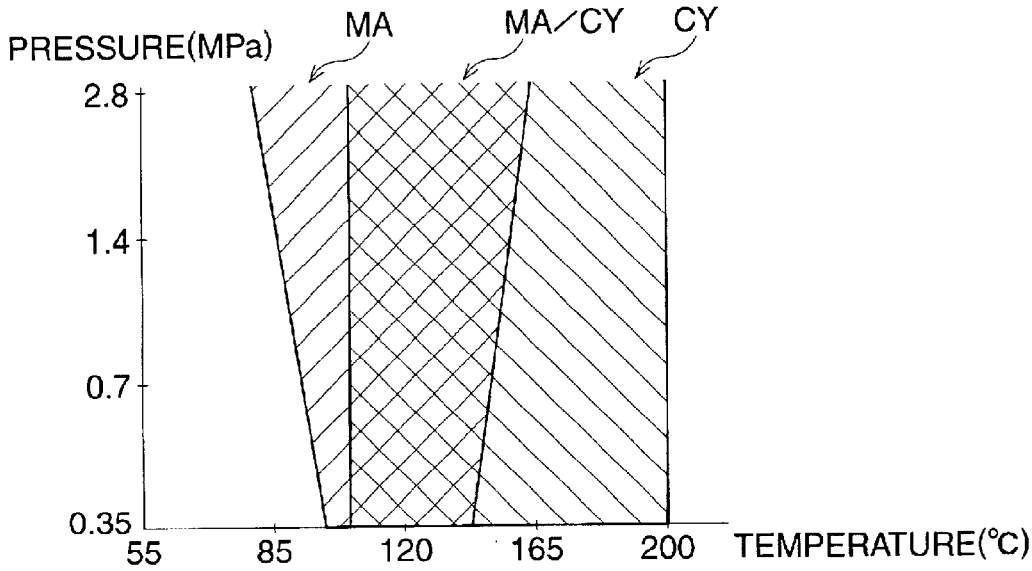
FIG. 7 is a graph illustrating color developing characteristics of the first embodiment provided that the color developing layer of the image-forming medium contains a filler component.

As is apparent from a comparison of the graph of FIG. 7 and the graph of FIG. 6, when the filler (Aerojiru-200) is added to the pressure/heat-sensitive color developing layer (16P), the magenta-developing area "MA" is widened. It is assumed that the increased width of the magenta-developing area "MA" has resulted from the fact that the slippage of the microcapsules (18) from the nip between the PET sheet (12) and the resistance element ($R_1$, . . . , $R_n$) is hindered due to the addition of the filler (Aerojiru-200) to the pressure/heat-sensitive color developing layer (16P). In short, it is possible to regulate an extent of the magenta-developing area "MA" by adding the filler to the pressure/heat-sensitive color developing layer (16P).

In a third type of image-forming medium, a plurality of pressure-sensitive microcapsules, having an average diameter of about 3 $\mu$m, was substituted for the aforesaid microcapsules 18 having the average diameter of about 5 to 6 $\mu$m. Of course, the microcapsules, having the average diameter of about 3 $\mu$m, were constituted so as to be squashed and broken when being subjected to the pressure of higher than about 0.35 MPa, with the shearing force.

In particular, an aqueous compound A", which is identical to the aforesaid aqueous compound A except that the microcapsules, having the average diameter of about 3 $\mu$m, was prepared. A pressure/heat-sensitive color-developing layer (16P) was formed by coating a PET sheet (12) with the aqueous compound A" at about 4 to 6 g per square meter, using a No.6/Mayer-Bar, and then a heat-sensitive color developing layer (16T) was formed by coating the pressure/ heat-sensitive color-developing layer (16P) with the aforesaid aqueous compound B at about 4 to 6 g per square meter, using a No.6/Mayer-Bar. In short, the third type of image-forming medium is identical to the first type of image-forming medium (FIG. 6) except that the pressure/heat sensitive color-developing layer contains the microcapsules having the average diameter of about 3 $\mu$m.

With respect to the third type of image-forming medium, color developing characteristics were investigated, using the thermal printer as shown in FIGS. 2 and 3, by carrying out an experiment in the same manner as mentioned above. The results of the experiment is shown in a graph of FIG. 8, in which respective magenta-, blue- and cyan-developing areas are also indicated by references "MA", "MA/CY" and "CY".

Figure 8:
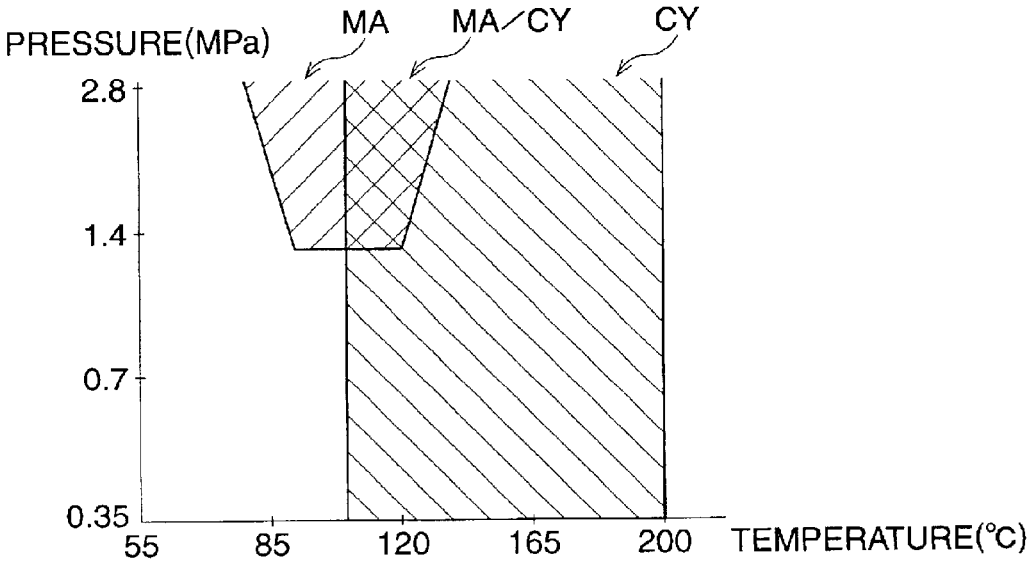
FIG. 8 is a graph illustrating color developing characteristics of the first embodiment provided that an average diameter of pressure-sensitive microcapsules contained in the image-forming medium is varied.

As is apparent from a comparison of the graph of FIG. 8 and the graph of FIG. 6, when the average diameter of the microcapsules is made smaller, the magenta-developing area "MA" is narrowed. It is assumed that the narrowness of the magenta-developing area "MA" has resulted from the fact that the slippage of the microcapsules from the nip between the PET sheet (12) and the resistance element ($R_1, \ldots, R_n$) is further facilitated as the average diameter of the microcapsules is made smaller. In short, it is possible to regulate an extent of the magenta-developing area "MA" by varying the average diameter of the pressure-sensitive microcapsules (18).

In a fourth type of image-forming medium, a coated paper was substituted for a PET sheet (12). The coated paper has a thickness of 0.072 mm, and exhibits a Bekk-smoothness degree of more than 1000. In particular, a pressure/heat-sensitive color-developing layer (16P) was formed by coating the coated paper with the aforesaid aqueous compound A at about 4 to 6 g per square meter, using a No. 6/Mayer-Bar, and then a heat-sensitive color developing layer (16T) was formed by coating the pressure/heat-sensitive color-developing layer with the aforesaid aqueous compound B at about 4 to 6 g per square meter, using a No.6/Mayer-Bar. In short, the fourth type of image-forming medium is identical to the first type of image-forming medium (FIG. 6) except that the coated paper is substituted for the PET sheet (12).

With respect to the fourth type of image-forming medium, color developing characteristics were investigated, using the thermal printer as shown in FIGS. 2 and 3, by carrying out an experiment in substantially the same manner as mentioned above, but the pressure, exerted by the resistance elements ($R_1, \ldots, R_n$) on the fourth type of image-forming medium, was discretely varied in a range of from 0.7 MPa to 4.2 MPa. The results of the experiment is shown in a graph of FIG. 9, in which respective magenta-, blue- and cyan-developing areas are also indicated by references "MA", "MA/CY" and "CY".

Figure 9:
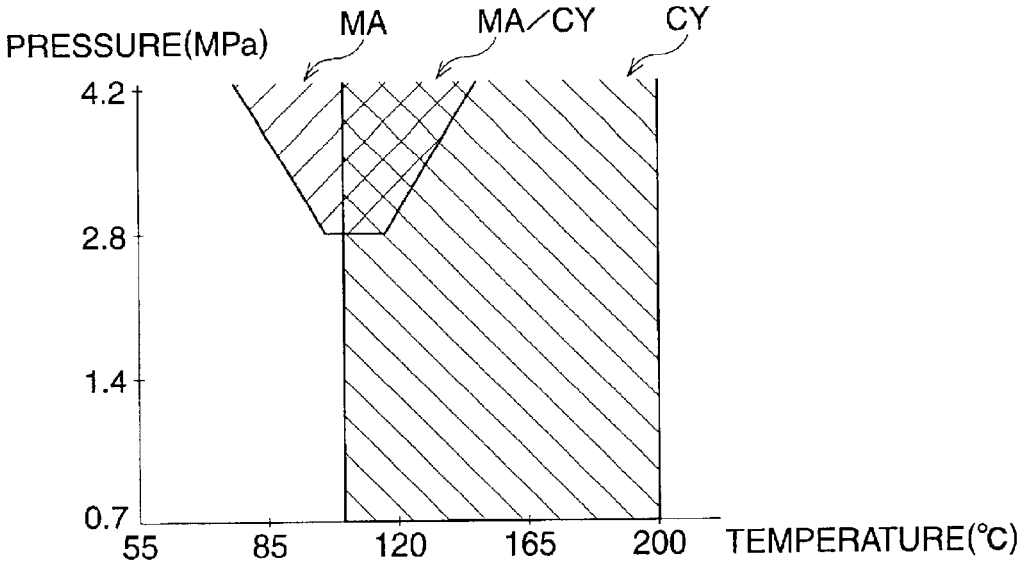
FIG. 9 is a graph illustrating color developing characteristics of the first embodiment provided that a substrate material of the image-forming medium is changed.

As is apparent from a comparison of the graph of FIG. 9 and the graph of FIG. 6, when the coated paper is substituted for the PET sheet (12), the magenta-developing area "MA" is narrowed. It is assumed that the narrowness of the magenta-developing area "MA" has resulted from the fact that the coated paper is softer than the PET sheet (12). Namely, due to the softness of the coated paper, the breaking pressure cannot be sufficiently exerted on the microcapsules (18). In short, it is possible to regulate an extent of the magenta-developing area "MA" by suitably selecting a material of the sheet-like substrate (12).

In a fifth type of image-forming medium, a plurality of pressure-sensitive microcapsules, having a shell wall thickness thinner than that of the aforesaid microcapsules 18, was utilized. The microcapsules concerned were produced in substantially the same manner as mentioned above, but an amount of melamine, contained in the melamine-formalin prepolymer aqueous solution (C), was reduced from 14 g to 11.2 g. Thus, the microcapsules concerned are more susceptible to breakage in comparison with the aforesaid microcapsules 18.

In particular, an aqueous compound A''', which is identical to the aforesaid aqueous compound A except that the microcapsules, more susceptible to the breakage in comparison with the aforesaid microcapsules 18, was prepared. A pressure/heat-sensitive color-developing layer (16P) was formed by coating a coated paper with the aqueous compound A''' at about 4 to 6 g per square meter, using a No. 6/Mayer-Bar, and then a heat-sensitive color developing layer (16T) was formed by coating the pressure/heat-sensitive color-developing layer (16P) with the aforesaid aqueous compound B at about 4 to 6 g per square meter, using a No. 6/Mayer-Bar. The coated paper has a thickness of 0.072 mm, and exhibits a Bekk-smoothness degree of more than 1000. In short, the fifth type of image-forming medium is identical to the fourth type of image-forming medium (FIG. 9) except that the pressure/heat sensitive color-developing layer (16P) contains the microcapsules which are more susceptible to breakage in comparison with the aforesaid microcapsules 18.

With respect to the fifth type of image-forming medium, color developing characteristics were investigated, using the thermal printer as shown in FIGS. 2 and 3, by carrying out an experiment in substantially the same manner as mentioned above, but the pressure, exerted by the resistance elements ($R_1, \ldots, R_n$) on the fifth type of image-forming medium, was discretely varied in a range of from 0.7 MPa to 4.2 MPa. The results of the experiment is shown in a graph of FIG. 10, in which respective magenta-, blue- and cyan-developing areas are also indicated by references "MA", "MA/CY" and "CY".

Figure 10:
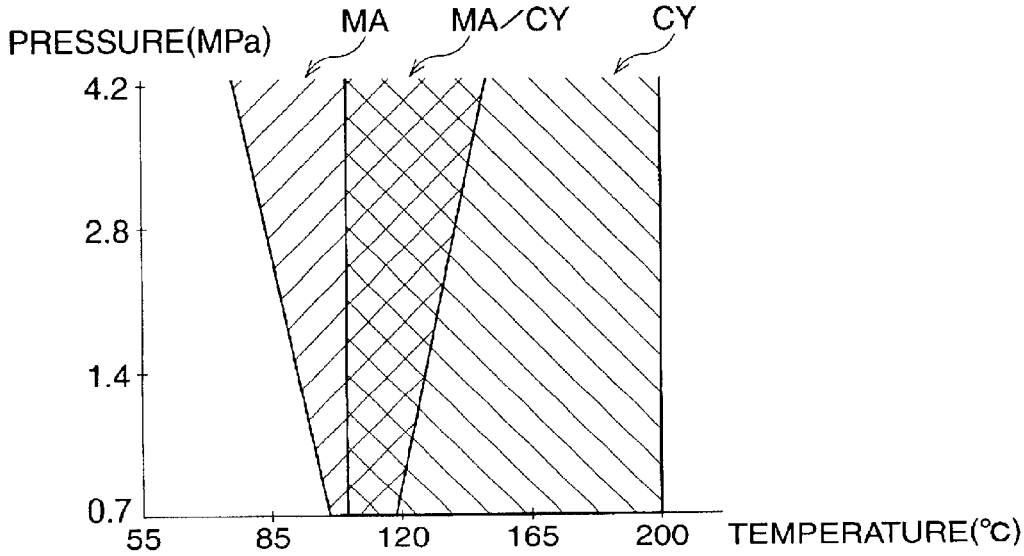
FIG. 10 is a graph illustrating color developing characteristics of the first embodiment provided that a shell wall strength of pressure-sensitive microcapsules contained in the image-forming medium is changed.

As is apparent from a comparison of the graph of FIG. 10 and the graph of FIG. 9, when the microcapsules concerned are more susceptible to breakage in comparison with the aforesaid microcapsules 18, the magenta-developing area "MA" is widened. It can be assumed that the increased width of the magenta-developing area "MA" has resulted from the fact that the microcapsules concerned are more susceptible to breakage in comparison with the aforesaid microcapsules 18. In short, it is possible to regulate an extent of the magenta-developing area "MA" by varying the shell wall thickness of the pressure-sensitive microcapsules (18).

In a sixth type of image-forming medium, a coated paper was substituted for a PET sheet (12). The coated paper has a thickness of 0.072 mm, and exhibits a Bekk-smoothness degree of 300 to 400. In particular, a pressure/heat-sensitive color-developing layer (16P) was formed by coating the coated paper with the aforesaid aqueous compound A at about 4 to 6 g per square meter, using a No.6/Mayer-Bar, and then a heat-sensitive color developing layer (16T) was formed by coating the pressure/heat-sensitive color-developing layer with the aforesaid aqueous compound B at about 4 to 6 g per square meter, using a No.6/Mayer-Bar. In short, the sixth type of image-forming medium is identical to the fourth type of image-forming medium (FIG. 9) except that the coated paper, exhibiting the Bekk-smoothness degree of 300 to 400, is substituted for the coated paper exhibiting the Bekk-smoothness degree of more than 1000, i.e. that the coated paper concerned features a surface roughness greater than that of the coated paper utilized in the fourth type of image-forming medium (FIG. 9).

With respect to the sixth type of image-forming medium, color developing characteristics were investigated, using the thermal printer as shown in FIGS. 2 and 3, by carrying out an experiment in substantially the same manner as mentioned above, but the pressure, exerted by the resistance elements ($R_1, \ldots, R_n$) on the fourth type of image-forming medium, was discretely varied in a range of from 0.7 MPa to 4.2 MPa. The results of the experiment is shown in a graph of FIG. 11, in which respective magenta-, blue- and cyan-developing areas are also indicated by references "MA", "MA/CY" and "CY".

Figure 11:
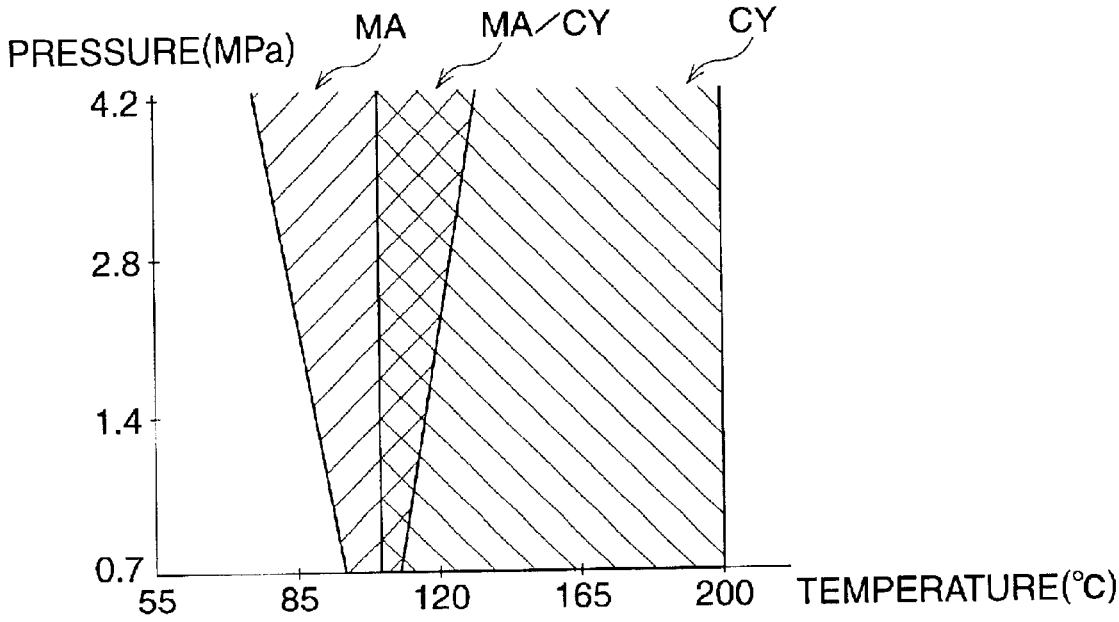
FIG. 11 is a graph illustrating color developing characteristics of the first embodiment provided that a surface roughness of the substrate of the image-forming medium is changed.

As is apparent from a comparison of the graph of FIG. 11 and the graph of FIG. 9, when the coated paper, featuring the rough surface, is substituted for the coated paper featuring the smooth surface, the magenta-developing area "MA" is widened. It can be easily assumed that the increased width of the magenta-developing area "MA" has resulted from the fact that the slippage of the microcapsules (18) from the nip between the PET sheet (12) and the resistance element ($R_1, \ldots, R_n$) is hindered due to the rough surface of the coated paper concerned. In short, it is possible to regulate an extent of the magenta-developing area "MA" by varying a surface roughness of the sheet-like substrate (12).

As is apparent from the foregoing, the extent of the magenta-developing area "MA" can be regulated by selecting and varying at least one of the various parameters: the thickness of the color-developing layer 14; the amount of filler to be contained in the pressure/heat-sensitive color-developing layer 16P; the average diameter of the pressure-sensitive microcapsules 18; the material of the sheet-like substrate 12; the shell wall strength of the pressure-sensitive microcapsules 18; and the surface roughness of the sheet-like substrate 12.

In the first embodiment, a cyan-developing leuco-pigment, utilized to form the color-developing layer 14, is very restrictive, because the cyan-developing leuco-pigment component must exhibit a color-developing temperature of around 105° C. before the color-developing layer 14 can feature the color-developing characteristic, as shown in the graph of FIG. 5. However, a magenta-developing leuco-pigment, utilized in the microcapsules 18, can be selected without being substantially subjected to any restrictions. Namely, although the magenta dye encapsulated in the microcapsules 18 is based on Red-3, it is possible to optionally utilize another type of magenta-developing leuco-pigment which exhibits a desired tone.

Further, for a dye encapsulated in the microcapsules 18, a pigment other than leuco-pigment may be utilized provided that the shell wall of the microcapsules 18 is colored white. In this case, the pressure/heat sensitive color developer 16P may be constituted as a binder layer containing the microcapsules 18 uniformly distributed therein, and the binder layer may be formed of a suitable wax material exhibiting a low melting point of about 90° C.

Figure 12:
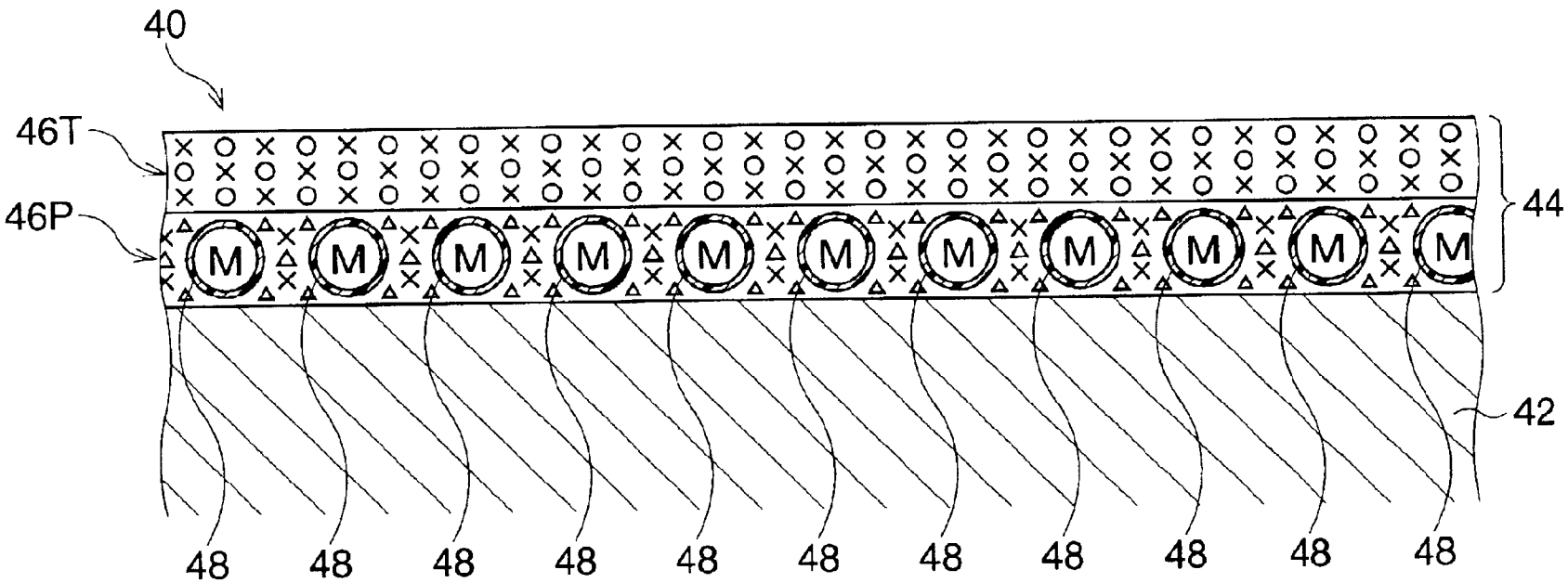
FIG. 12 is a schematic cross-sectional view showing a second embodiment of a color image-forming medium, according to the present invention.

FIG. 12 shows a second embodiment of a color image-forming medium, generally indicated by reference numeral 40, according to the present invention. The image-forming medium 40 comprises a sheet of coated paper 42, and a color-developing layer 44 coated thereon. The paper sheet 42 has a thickness of 0.072 mm, and exhibits a Bekk smoothness degree of 400. The color-developing layer 44 is also formed as a double-layer structure including a pressure/heat-sensitive color-developing layer 46P coated on the paper sheet 42, and a heat-sensitive color-developing layer 46T coated thereon.

The pressure/heat sensitive color-developing layer 46P is constituted as a heat-sensitive color-developing layer containing a plurality of pressure-sensitive microcapsules 48 uniformly distributed therein, and the heat-sensitive color-developing layer is composed of a black-developing leuco-pigment component represented by symbols "Δ", and a color developer component represented by symbols "×". For the black-developing leuco-pigment component "Δ", ETAC is utilized. Note, ETAC is available from YAMADA CHEMICAL K.K., and exhibits a melting point of about 208° C., substantially equivalent to a color-developing temperature thereof. For the color developer component "×", K-5 is utilized. Although not shown in FIG. 12, the pressure/heat-sensitive color-developing layer 46P contains a suitable amount of stearic acid amide which serves as a sensitizer for regulating the color-developing temperatures of the black-developing leuco-pigment component "Δ" and color developer component "×".

The pressure-sensitive microcapsules 48 are essentially identical to the aforesaid microcapsules 18 utilized in the first embodiment. Namely, the microcapsules 48 are filled with the magenta ink or dye composed of KMC-113 and Red-3, and are constituted so as to be squashed and broken when being subjected to the pressure of higher than about 0.35 MPa, with the shearing force.

The heat-sensitive color-developing layer 46T is composed of an emerald-green-developing leuco-pigment component represented by symbols "○", and a color developer component represented by symbols "×". For the emerald-green-developing leuco-pigment component "○", GREEN-118 is utilized. Note, GREEN-118 is available from YAMAMOTO KASEI K.K., and exhibits a melting point of about 243° C., substantially equivalent to a color-developing temperature thereof. For the color developer component "×", K-5 is utilized. Although not shown in FIG. 12, the heat-sensitive color-developing layer 46T also contains a suitable amount of stearic acid amide which serves as a sensitizer for regulating the color-developing temperature of the emerald-green-developing leuco-pigment component "○" and the melting point of the color developer component "×".

To produce the pressure/heat-sensitive color-developing layer 46P, an aqueous compound C is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % ETAC aqueous dispersion | 1.0 |
| (3) 20 wt. % K-5 aqueous dispersion | 1.0 |
| (4) 16 wt. % stearic acid amide aqueous dispersion | 0.5 |
| (5) 20 wt. % PVA aqueous solution | 0.5 |

Herein:

The composition (1) is prepared by mixing 25 wt. % of the microcapsules 48 with purified water;

The composition (2) is prepared by mixing 17 wt. % of ETAC (black-developing leuco-pigment) with purified water, ETAC being a powder having an average diameter of less than 1 μm;

The composition (3) is prepared by mixing 20 wt. % of K-5 (color developer with purified water;

The composition (4) is prepared by mixing 16 wt. % of stearic acid amide (sensitizer) with purified water, this sensitizer being a powder having an average diameter of less than 1 μm; and The composition (5) is prepared b dissolving 20 wt. % of polyvinyl alcohol (PVA) in purified water, PVA featuring a polymerization degree of 500.

The coated paper 42 is coated with the aqueous compound A at about 4 to 6 g per square meter, using a No.6/Mayer- Bar, and then the coated layer is allowed to dry naturally, resulting in the production of pressure/heat-sensitive color-developing layer 46P.

Since the color-developing layer 46P contains stearic acid amide (sensitizer), the melting point of the color developer component (K-5) is lowered from 145° C. to about 90° C., and the color-developing temperature of the black-developing leuco-pigment (ETAC) is lowered to about 180° C.

To produce the heat-sensitive color-developing layer 46T, an aqueous compound D is prepared, composed as shown in the following table:

| COMPOSITIONS | PARTS BY WEIGHT |
|---|---|
| (1) 17 wt. % GREEN-118 aqueous dispersion | 1.0 |
| (2) 20 wt. % K-5 aqueous dispersion | 1.0 |
| (3) 16 wt. % stearic acid amide aqueous dispersion | 0.5 |
| (4) 20 wt. % PVA aqueous solution | 0.5 |

Note that the aqueous compound D is essentially identical to the aqueous compound B except that the composition (1) is prepared by mixing 17 wt. % of GREEN-118 (emerald-green-developing leuco-pigment) with purified water, GREEN-118 being a powder having an average diameter of less than 1 $\mu$m.

The pressure/heat-sensitive color-developing layer 46P is coated with the aqueous compound D at about 4 to 6 g per square meter, using a No.6/Mayer-Bar, and then the coated layer is allowed to dry naturally, resulting in the production of heat-sensitive color-developing layer 46T, and therefore, the color image-forming medium 40.

Since the color-developing layer 46T contains stearic acid amide (sensitizer), the melting point of the color developer component (K-5) is lowered from 145° C. to about 90° C., and the color-developing temperature of the emerald-green-developing leuco-pigment component (GREEN-118) is lowered to about 105° C.

With respect to the color-image-forming medium 40, an experiment was carried out to investigate color developing characteristics, using the thermal printer as shown in FIGS. 2 and 3. Namely, in the experiment, the pressure, exerted by the resistance elements ($R_1$, . . . , $R_n$) on the color image-forming medium 40, was discretely varied in a range of from 0.35 MPa to 2.8 MPa, and the heating temperature of the resistance elements ($R_1$, . . . , $R_n$) was discretely varied in a range of from 80° C. to 200° C.

Figure 13:
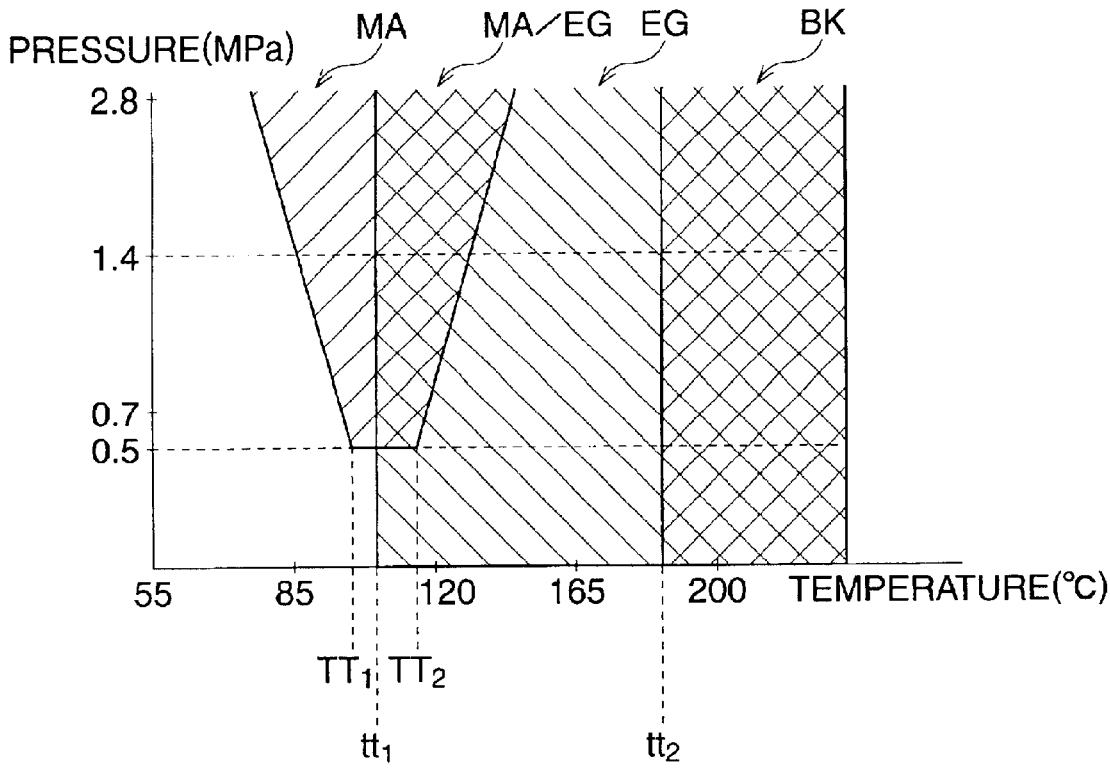
FIG. 13 is a graph illustrating color developing characteristics of the second embodiment shown in FIG. 12.

The results of the experiment are shown in a graph of FIG. 13. In this graph, a hatching area, indicated by reference "MA", is a magenta-developing area; a hatching area, indicated by reference "EG" is an emerald-green-developing area; a cross-hatching area, overlapped by both the developing areas "MA" and "EG", is a dark-blue-developing area indicated by reference "MA/EG"; and a cross-hatching area, indicated by reference "BK", is a black-developing area. When the pressure is 0.5 MPa, the magenta-developing area "MA" is defined as a temperature range between critical temperatures of $TT_1$ and $TT_2$; the emerald-green-developing area "EG" is defined as a temperature range more than a critical temperature $tt_1$; the dark-blue-developing area "MA/EG" is defined as a temperature range between the critical temperatures of $tt_1$ and $TT_2$; and the black-developing area "BK" is defined as a critical temperature range more than the critical temperature $tt_2$.

Note, the temperature of $TT_1$ is equivalent to the melting point (95° C.) of the color developer component "×"; the temperature of $TT_2$ is equivalent to a critical temperature of 110° C. at which the microcapsules 48 are not squashed and broken when the pressure is 0.35 Mpa; the temperature of $tt_1$ is equivalent to the color-developing temperature (105° C.) of the emerald-green-developing leuco-pigment component "○"; and the temperature of $tt_2$ is equivalent to the color-developing temperature (180° C.) of the black-developing leuco-pigment component "Δ".

Thus, it is possible to record a color image on the color-developing layer 44 of the image-forming medium 40 with four colors (magenta, dark blue, emerald green and black), using the printer as shown in FIGS. 2 and 3. When the pressure, exerted by the resistance elements ($R_1$, . . . , $R_n$) on the image-forming medium 40, is 1.4 MPa, the respective temperatures of $TT_1$ and $TT_2$ may be selected as a magenta-developing temperature and a dark-blue-developing temperature, and respective suitable temperatures of 165° C. and 200° C. may be selected as an emerald-green-developing temperature and a black-developing temperature.

Thus, it is necessary to somewhat modify the printer as shown in FIGS. 2 and 3, before a color image can be formed and recorded on the color-developing layer 44 of the image-forming medium 40. Namely, when any one of the resistance elements $R_1$ to $R_n$ is energized in accordance with a magenta pixel signal, the element concerned is heated to a temperature of 95° C.; when any one of the resistance elements $R_1$ to $R_n$ is energized in accordance with a dark blue pixel signal, the element concerned is heated to a temperature of 110° C.; when any one of the resistance elements $R_1$ to $R_n$ is energized in accordance with an emerald green pixel signal, the element concerned is heated to a temperature of about 165° C.; nd when any one of the resistance elements $R_1$ to $R_n$ is energized in accordance with a black pixel signal, the element concerned is heated to a temperature of about 200° C.

Similar to the first embodiment, while the image-forming medium 40 passes between the thermal printing head 30 and the roller platen 34, the color-developing layer 44 is subjected to the pressure of 1.4 MPa with the shearing force from the electric resistance elements ($R_1$, . . . , $R_n$) of the thermal printing head 30. Nevertheless, as long as each of the resistance elements is not electrically energized and heated to the temperature of at least 95° C., each resistance element cannot exert the pressure of 1.4 MPa with the shearing force on the microcapsules 48 due to the solid phase of the color-developing layer 44, and thus the microcapsules 48 are prevented from being squashed and broken.

However, when any one of the resistance elements $R_1$ to $R_n$ is energized in accordance with a color pixel signal, the element concerned is heated to a temperature of at least 95° C., whereby the color developer component "×" is thermally softened or fused due the existence of the sensitizer. Accordingly, the heated element ($R_1$, . . . , $R_n$) penetrates into the color-developing layer 44. Thus, the microcapsules 48, included in the penetrated area of the color-developing layer 44, are directly subjected to the pressure 1.4 MPa, with the shearing force, from the heated element ($R_1$, . . . , $R_n$), and thus are squashed and broken, resulting in discharge of the magenta dye from the broken microcapsules 48.

When the energization of the element concerned is based on the magenta pixel signal, the heating temperature of the element is 95° C. Thus, a magenta dot is produced on the color-developing layer 44, because only magenta is developed due to the heating temperature of the element being 95° C., less than both the color-developing temperatures (105° C. and 180° C.) of the leuco-pigment components "○" and "Δ".

Also, when the energization of the element concerned is based on the dark-blue pixel signal, the heating temperature of the element is 105° C. Thus, a dark-blue dot is produced on the color-developing layer 44, because both magenta and emerald green are developed due to the heating temperature of the element being 105° C. more than the color-developing temperature (105° C.) of the leuco-pigment component "○".

Further, when the energization of the element concerned is based on the emerald green pixel signal, the heating temperature of the element is 165° C. Thus, an emerald green dot is produced on the color-developing layer 44, because only emerald green is developed as the microcapsules 48 are not squashed and broken for the reasons stated hereinbefore.

Furthermore, when the energization of the element is based on the black pixel signal, the heating temperature of the element is 200° C. Thus, a black dot is produced on the color-developing layer 44, because black is developed as the heating temperature of the element is 200° C. more than the color-developing temperature (180° C.) of the emerald-green-developing leuco-pigment component "○". Note, although emerald green is developed at the heating temperature of 200° C. of the element, the emerald green is absorbed by the black.

Figure 14:
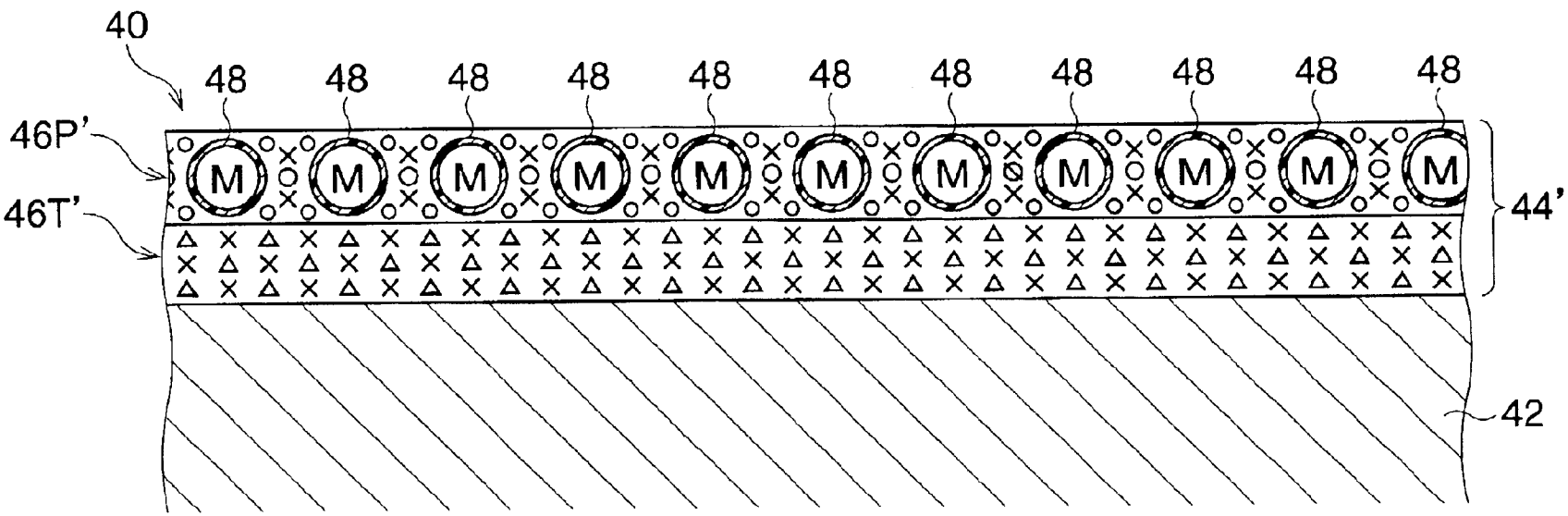
FIG. 14 is a schematic cross-sectional view showing a modification of the second embodiment shown in FIG. 12.

FIG. 14 shows a modification of the second embodiment. In this drawing, the same features are indicated by the same references and symbols, and like features bear like references primed.

In the modified embodiment, a color image-forming medium 40' comprises a sheet of coated paper 42, and a color-developing layer 44' coated thereon. Similar to the second embodiment, although the color-developing layer 44' is formed as a double-layer structure, a heat-sensitive color-developing layer 46T' is directly formed on the paper sheet 42, and a pressure/heat-sensitive color-developing layer 46P' is formed thereon. Also, in the second embodiment, although the respective color-developing layers 46P and 46T contain the black-developing leuco-pigment component "Δ" and the emerald-green-developing leuco-pigment component "○", the respective leuco-pigment components "Δ" and "○" are substituted for the leuco-pigment components "○" and "Δ" in the color-developing layers 46P' and 46T'.

The modified color-image-forming medium 40' features substantially the same color-developing characteristics as shown in the graph of FIG. 13. Thus, it is possible to form and record a color image in substantially the same manner as mentioned above, using the printer as shown in FIGS. 2 and 3.

Note that the various changes and modifications of the first embodiment may be applied to the second embodiment and the modified embodiment thereof, if possible.

In the above-mentioned embodiments, although the color developing layer (14, 44, 44') is formed as the double-layer structure, it is possible to form the color developing layer (14, 44, 44') as a single-layer structure. For example, if the color-developing layer 44 is formed as the single-layer structure, the aqueous compounds C and D are mixed at a rate of 1:1, and the paper sheet 42 is coated with the aqueous mixture at about 5 to 7 g per square meter, and then the coated layer is allowed to dry naturally, resulting in the production of the color-developing layer as a single-layer structure.

On the other hand, when black is developed as in the a case of the second embodiment, a color developing layer (44) may be formed as a triple-layer structure. Namely, for example, in the second embodiment, the color developing layer 44 may be composed of a first layer section corresponding to the heat-sensitive color developer 46T' (FIG. 14), a second layer section corresponding to the heat-sensitive color developer 46T (FIG. 13), and a third layer section corresponding to the pressure/heat-sensitive color developer 16P (FIG. 1). In this case, preferably, the first, second and third layer sections are successively formed on the paper sheet 42, and each layer section is obtained by coating a corresponding aqueous compound at about 2 to 4 g per square meter.

Figure 15:
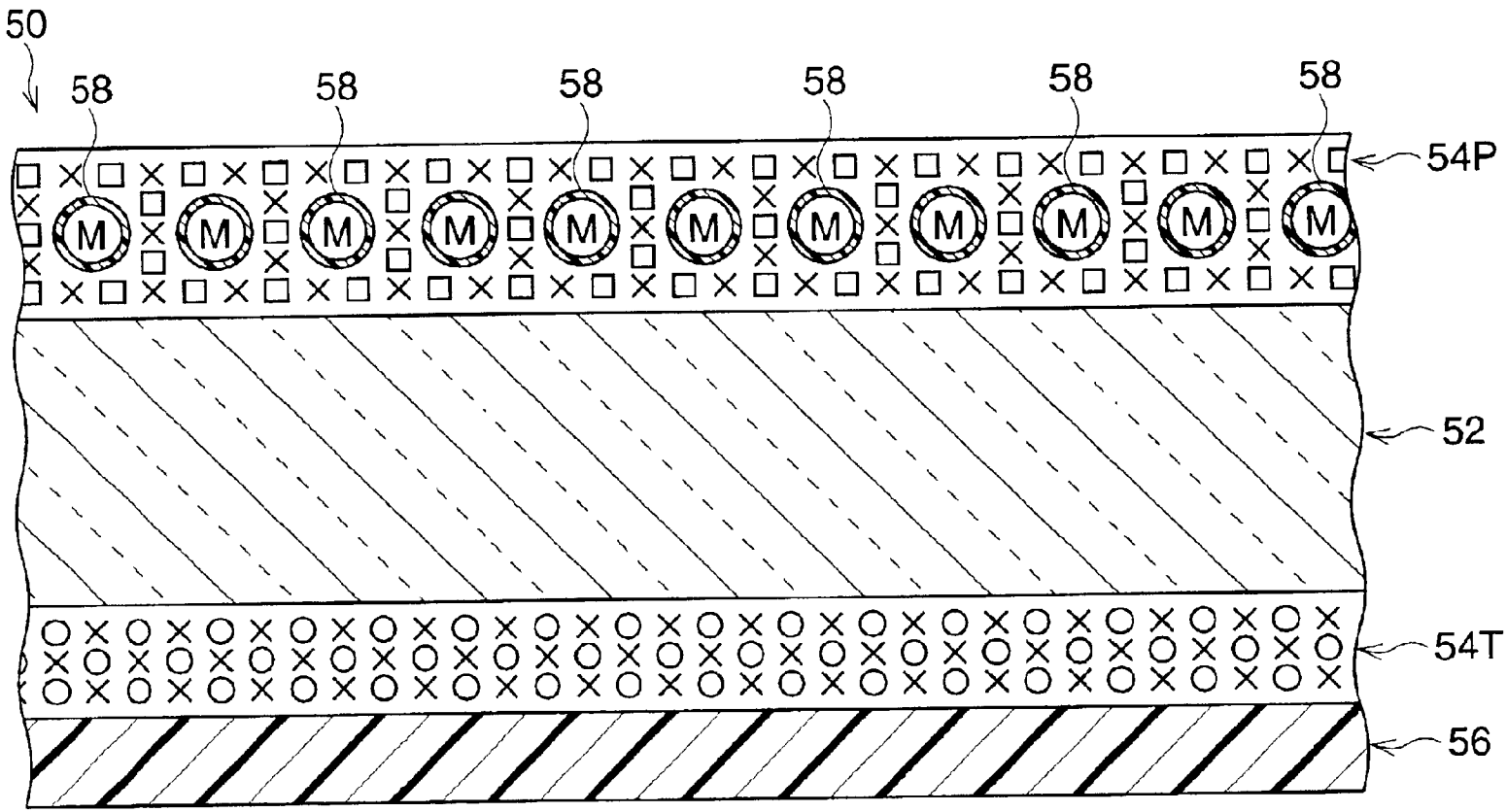
FIG. 15 is a schematic cross-sectional view showing a third embodiment of a color image-forming medium, according to the present invention.

FIG. 15 shows a third embodiment of a color-image-forming medium, generally indicated by reference numeral 50, according to the present invention, which is constituted such that a full color image can be formed thereon. The image-forming medium 50 comprises a suitable transparent sheet-like substrate 52, a pressure/heat-sensitive color-developing layer 54P coated on one surface of the substrate 52, a heat-sensitive color developing layer 54T coated on the other surface of the substrate 52, and a reflective layer 56 formed on the heat-sensitive color developing layer 54T.

The substrate 52 is formed as a sheet of polyethylene terephthalate (PET) having a thickness of about 50 to 100 μm. The transparent PET sheet 52 is utilized not only as the substrate for forming the color-developing layers 54P and 54T but also as a heat-insulating barrier for thermally insulating the color-developing layers 54P and 54T from each other.

The pressure/heat-sensitive color-developing layer 54P is constituted as a heat-sensitive color-developing layer containing a plurality of pressure-sensitive microcapsules 58 uniformly distributed therein, and the heat-sensitive color-developing layer is composed of a cyan-developing leuco-pigment component represented by symbols "□", and a color developer component represented by symbols "×". For the cyan-developing leuco-pigment component "□", NC-Blue-3 is utilized. Note, NC-Blue-3 is available from HODOGAYA CHEMICAL K. K., and exhibits a melting point of about 190° C., substantially equivalent to a color-developing temperature thereof. For the color developer component "×", K-5 is utilized. Although not shown in FIG. 15, the pressure/heat-sensitive color-developing layer 54 contains a suitable amount of stearic acid amide which serves as a sensitizer for regulating the color-developing temperature of the cyan-developing leuco-pigment component "□" and the melting point of the color developer component "×".

The pressure-sensitive microcapsules 58 are substantially identical to the aforesaid microcapsules 18 except that the microcapsules 58 features an average diameter of about 3 to 4 μm, and are constituted so as to be squashed and broken when being subjected to a pressure of higher than about 0.5 MPa, with a shearing force. Of course, the microcapsules 58 are filled with the magenta ink or dye composed of KMC-113 and Red-3, and may be produced by the aforesaid in-site polymerization method.

The heat-sensitive color-developing layer 54T is composed of a yellow-developing leuco-pigment component represented by symbols "○", and a color developer component represented by symbols "×". For the yellow-developing leuco-pigment component "○", I-3R is utilized. Note, I-3R is available from CIBA SPECIALTY CHEMICALS, and exhibits a melting point of 170° C., substantially equivalent to a color-developing temperature thereof. For the color developer component "×", K-5 is utilized. Although not shown in FIG. 15, the heat-sensitive color-developing layer 54T also contains a suitable amount of stearic acid amide which serves as a sensitizer for regulating the color-developing temperature of the yellow-developing leuco-pigment component "○" and the melting point of the color developer component "×".

To produce the pressure/heat-sensitive color-developing layer 54P, an aqueous compound E is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % NC-Blue-3 aqueous dispersion | 0.5 |
| (3) 16 wt. % K-5 aqueous dispersion | 1.5 |
| (4) 16 wt. % stearic acid amide aqueous dispersion | 0.5 |
| (5) 20 wt. % polyester aqueous solution | 0.5 |

Herein:

The composition (1) is prepared by mixing 25 wt. % of the microcapsules 58 with purified water;

The composition (2) is prepared by mixing 17 wt. % of NC-Blue-3 (cyan-developing leuco-pigment) with purified water, NC-Blue-3 being a powder having an average diameter of less than 1 $\mu$m;

The composition (3) is prepared by mixing 16 wt. % of K-5 (color developer) with purified water;

The composition (4) is perpared by mixing 16 wt.% of stearic acid amide (sensitizer) with purified water; and The (5) is prepared by dissolving 20 wt.% of Gabusen ES-901A (water-soluble polyester) in purified water, Gabusen ES-901A being available from TEIKOKU CHEMICAL K.K.

One surface of the transparent PET sheet 52 is coated with the aqueous compound E at about 4 to 5 g per square meter, using a No.8/Mayer-Bar, and then the coated layer is allowed to dry naturally, resulting in production of the pressure/heat-sensitive color-developing layer 54P. Note, Gabusen ES-901A serves as a binder for adhering the color developer component "×", the cyan-developing leuco-pigment component "□" and the microcapsules 58 to each other, and for adhering the color-developing layer 54P to the PET sheet 52. Also, note, the produced color-developing layer 54P is translucent or transparent due to the use of Gabusen ES-901A.

Since the color-developing layer 54P contains stearic acid amide (sensitizer), the melting point of the color developer component (K-5) is lowered from 145° C. to about 90° C., and the color-developing temperature of the cyan-developing leuco-pigment (NC-Blue-3) is lowered to about 140° C.

To produce the heat-sensitive color-developing layer 54T, an aqueous compound F is prepared, composed as shown in the following table:

| COMPOSITIONS | PARTS BY WEIGHT |
|---|---|
| (1) 17 wt. % I-3R aqueous dispersion | 0.5 |
| (2) 16 wt. % K-5 aqueous dispersion | 1.0 |
| (3) 16 wt. % stearic acid amide aqueous dispersion | 0.5 |
| (4) 10 wt. % PVA aqueous solution | 0.5 |

Herein:

The composition (1) is prepared by mixing 17 wt. % of I-3R (yellow-developing leuco-pigment) with purified water, I-3R being a powder having an average diameter of less than 1 $\mu$m;

The composition (2) is prepared by prepared by mixing 16 wt. % OF K-5 (color developer) with purified water;

The composition (3) is prepared by mixing 16 wt. % of stearic acid amide (sensitizer) with purified water; and The composition (4) is prepared by dissolving 10 wt. % of polyvinyl alcohol (PVA) in purified water, PVA featuring a polymerization degree of 500.

The heat-sensitive color-developing layer 54T is coated with the aqueous compound F at about 3 to 5 g per square meter, using a No.6/Mayer-Bar, and then the coated layer is allowed to dry naturally, resulting in production of the heat-sensitive color-developing layer 54T. Note, the produced color-developing layer 54T exhibits white due to the use of polyvinyl alcohol (PVA).

Since the color-developing layer 54T contains stearic acid amide (sensitizer), the melting point of the color developer component (K-5) is lowered from 145° C. to about 90° C., and the color-developing temperature of the yellow-developing leuco-pigment component (I-3R) is lowered to about 140° C.

After the color-developing layer 54T is completely dried, the reflective layer 56 is produced on the color-developing layer 54T. The reflective layer 56 may be formed as a film sheet of polyethylene terephthalate (PET) having a thickness of 6 m, and the film sheet is preferably colored white. The PET film sheet can be thermally adhered to the color-developing layer 54T by melting the color developer component "×" at a temperature of about 80 to 100° C., less than the color-developing temperature (140° C.) of the yellow-developing leuco-pigment "○". Optionally, the PET film may be adhered to the color-developing layer 54T with a suitable water-soluble adhesive solution, such as a PVA aqueous solution. Further, the reflective layer 56 may be formed by coating the color-developing layer with a suitable inorganic white powder, such as silica, titanium dioxide, calcium carbonate or the like.

Figure 16:
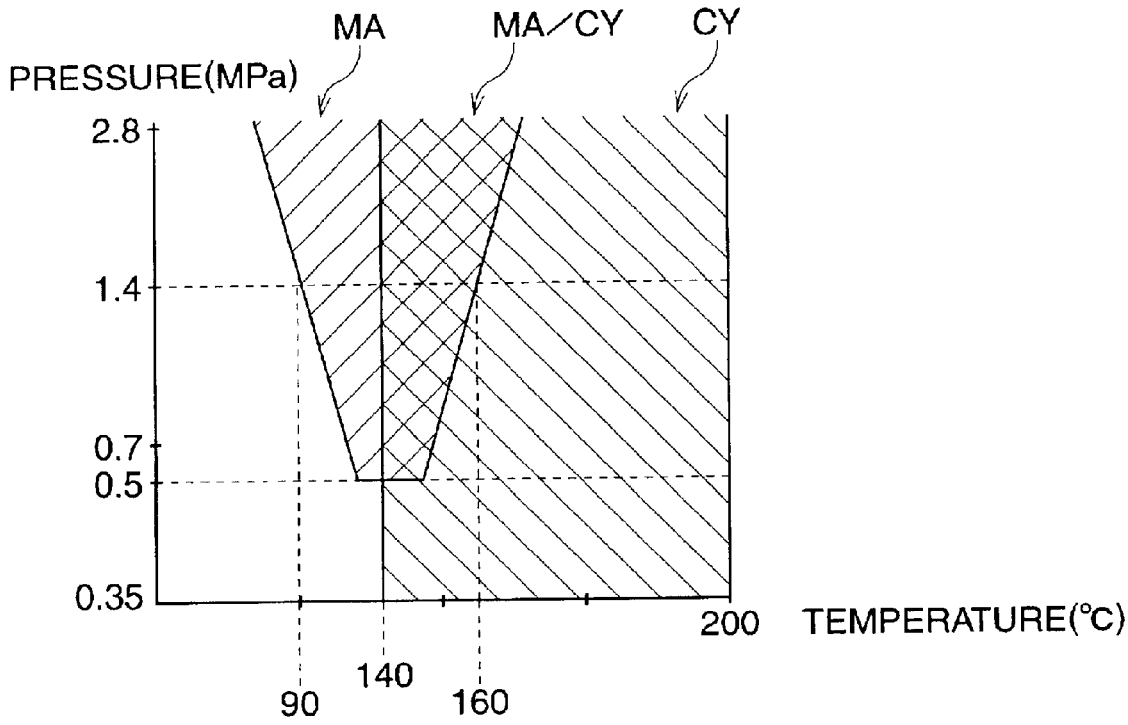
FIG. 16 is a graph illustrating color developing characteristics of a pressure/heat-sensitive color-developing layer of the third embodiment shown in FIG. 15.

Referring to FIG. 16, color developing characteristics of the pressure/heat-sensitive color-developing layer 54P is shown as a graph. In this graph, reference "MA" indicates a magenta-developing area; reference "CY" indicates a cyan-developing area; and reference "MA/CY" indicates a blue-developing area. When a pressure is 1.4 MPa, the magenta-developing area "MA" is defined as a temperature range between critical temperatures of 90° C. and 160° C., the cyan-developing area "CY" is defined as a temperature range more than a critical temperature of 140° C.

On the other hand, a color developing characteristic of the heat-sensitive color-developing layer 54T is similar to that of a conventional heat-sensitive image-forming sheet. Namely, when a temperature more than the color developing temperature (140° C.) of the yellow-developing leuco-pigment is exerted on the color-developing layer 54T, yellow is merely developed thereon.

Figure 17:
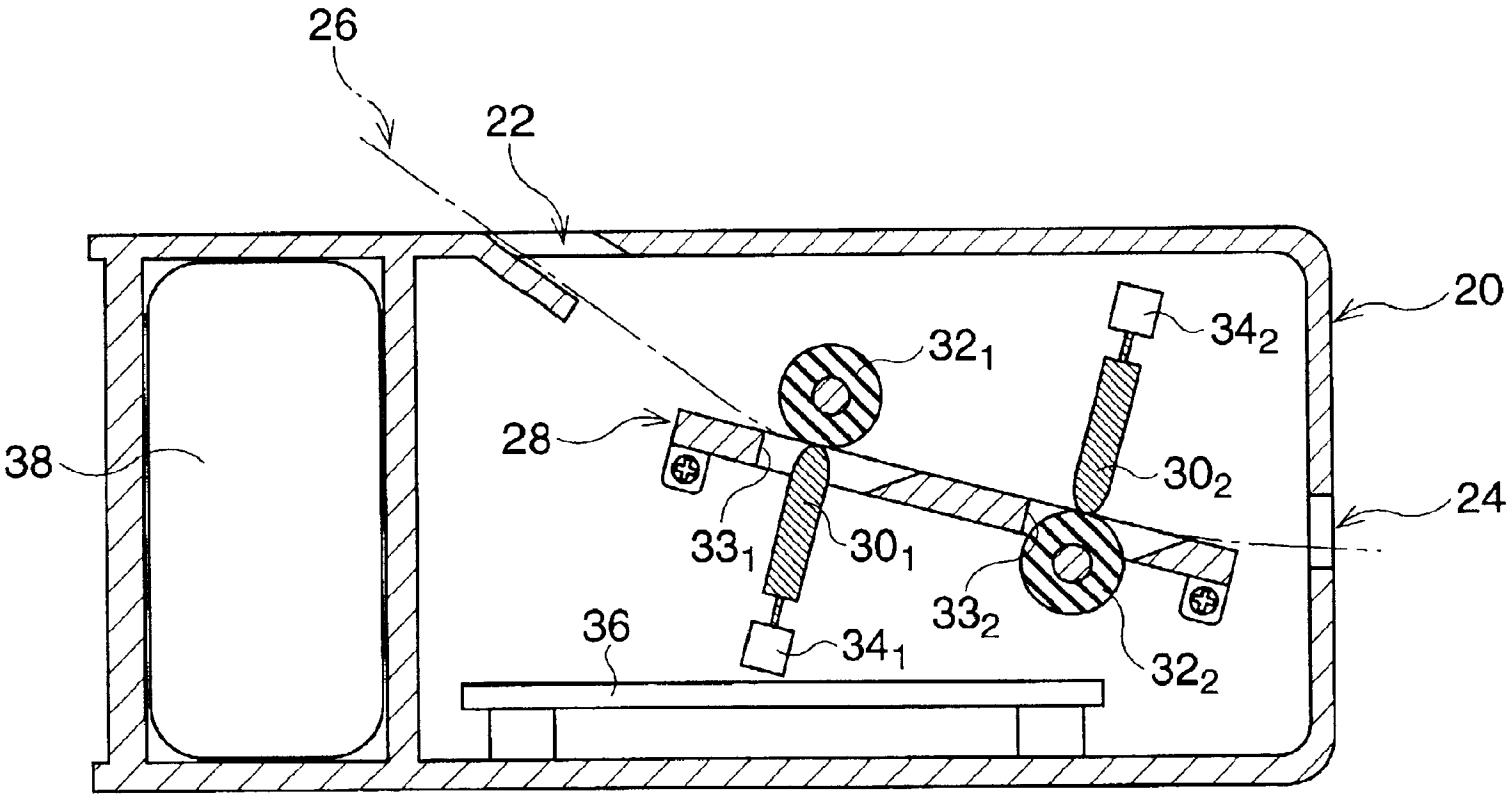
FIG. 17 is a schematic cross-sectional view of a line type printer for forming a color image on the image-forming medium shown in FIG. 15.

Before a full color image can be formed and recorded on the heat-sensitive color-developing layer 54T, the aforesaid printer (FIG. 2) must be modified as shown in FIG. 17. Note, in this drawing, the features similar to those of FIG. 2 are indicated by the same references.

As shown in FIG. 17, the modified printer is provided with a first set of movable thermal printing head $\mathbf{30}_1$ and roller platen $\mathbf{32}_1$ and a second set of movable thermal printing head $\mathbf{30}_2$ and roller platen $\mathbf{32}_2$. The guide plate 28 are formed with a first elongated slot $\mathbf{33}_1$ and a second elongated slot 332 for incorporating the first set of printing head $\mathbf{30}_1$ and roller platen $\mathbf{32}_1$ and a second set printing head $\mathbf{30}_2$ and second roller platen $\mathbf{32}_2$ in the guide plate 28.

In particular, the first thermal printing head $\mathbf{30}_1$ is received in the first elongated slot $\mathbf{33}_1$ and is abutted against the first platen roller $\mathbf{32}_1$ arranged to be tangential to a guide surface defined by the guide plate 28. On the other hand, the second roller platen $\mathbf{32}_2$ is received in the second elongated slot $\mathbf{33}_2$ to be tangential to the guide surface of the guide plate 28, and the second thermal printing head $\mathbf{30}_2$ is abutted against the second roller platen $\mathbf{32}_2$. The first thermal printing head $\mathbf{30}_1$ is associated with a first spring-biasing unit $\mathbf{34}_1$ to be elastically pressed against the roller platen $\mathbf{32}_1$ at a pressure of 1.4 MPa more than the critical breaking-pressure of 0.5 MPa of the microcapsules 58. The second thermal printing head $\mathbf{30}_2$ is associated with a second spring-biasing unit $\mathbf{34}_2$ so as to be elastically pressed against the roller platen $\mathbf{32}_2$ at a suitable pressure of, for example, 0.2 MPa less than the critical breaking-pressure of 0.5 MPa of the microcapsules 58.

During the printing operation, the first roller platen $\mathbf{32}_1$ is rotated in a counterclockwise direction (FIG. 17), and the second roller platen $\mathbf{32}_2$ is rotated in a clockwise direction (FIG. 17). Of course, the first and second roller platens $\mathbf{32}_1$ and $\mathbf{32}_2$ are rotated at the same peripheral speed under control of the control circuit board 37, so that the image-forming medium 50, introduced into the entrance opening 22, moves toward the exit opening 24 along the path 26. Note, the introduction of the color image-forming medium 50 is performed such that the respective color-developing layers 54P and 54T are in direct contact with the thermal printing heads $\mathbf{30}_1$ and $\mathbf{30}_2$.

The first thermal printing head $\mathbf{30}_1$ includes an n number of electric resistance elements, and the second thermal printing head $\mathbf{30}_2$ includes an n number of electric resistance elements. In each thermal printing head ($\mathbf{30}_1$ and $\mathbf{30}_2$), the resistance elements are aligned with each other along a length of the thermal printing head ($\mathbf{30}_1$ and $\mathbf{30}_2$) Further, the respective resistance elements of the first thermal printing head $\mathbf{30}_1$ are correspondingly aligned with the resistance elements of the second thermal printing head $\mathbf{30}_2$. In short, both the resistance elements of the first thermal printing head $\mathbf{30}_1$ and the resistance elements of the second thermal printing head $\mathbf{30}_2$ are arranged in a 2×n matrix manner.

With the arrangement of the modified printer, it is possible to form and record a full color image on the image-forming medium 50. In particular, a magenta image, a blue image and a cyan image can be formed on the color-developing layer 54P by suitably controlling heating temperatures of the resistance elements of the first thermal printing head $\mathbf{30}_1$. On the other hand, a yellow image can be formed on the color-developing layer 54T by suitably controlling heating temperatures of the resistance elements of the second thermal printing head $\mathbf{30}_2$. An image area, overlapped by the magenta image and the yellow image, is recognized as a red image when the image-forming medium 50 is observed from the side of the color-developing layer 54P. Also, an image area, overlapped by the blue image and the yellow image, is recognized as a black image when the image-forming medium 50 is observed from the side of the color-developing layer 54P. Further, an image area, overlapped by the cyan image and the yellow image, is recognized as a green image when the image-forming medium 50 is observed from the side of the color-developing layer 54P. In short, the magenta, cyan, yellow, blue, red, green and black images are recognized as a full color image when the image-forming medium 50 is observed from the side of the color-developing layer 54P.

Note, of course, the yellow image must be formed as a mirror image on the color-developing layer 54T with respect to the magenta, blue and cyan images formed on the color-developing layer 54P, before the full color image can be properly observed.

In the third embodiment, as stated hereinbefore, the PET sheet 52 serves as a heat-insulating barrier to thermally insulate the color-developing layers 54P and 54T from each other. Thus, when the first thermal printing head $\mathbf{30}_1$ is electrically energized, the development of yellow is prevented. Similarly, when the second thermal printing head $\mathbf{30}_2$ is electrically energized, the development of cyan is prevented.

Figure 18:
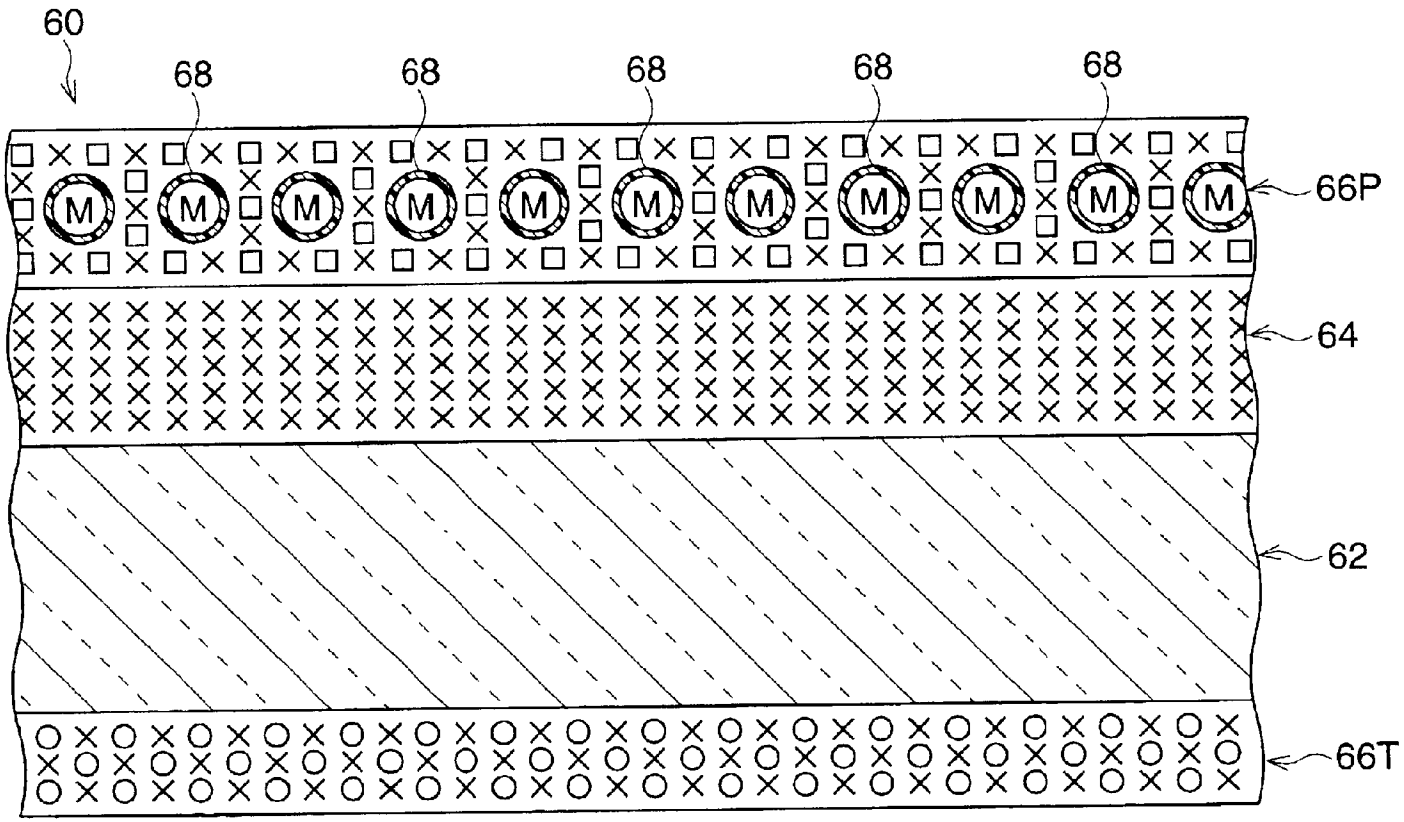
FIG. 18 is a schematic cross-sectional view showing a fourth embodiment of a color image-forming medium, according to the present invention.

FIG. 18 shows a fourth embodiment of a color-image-forming medium, generally indicated by reference numeral 60, according to the present invention, which is also constituted such that a full color image can be formed thereon. The image-forming medium 60 comprises a transparent polyethylene terephthalate (PET) sheet 62 having a thickness of about 100 $\mu$m, an image-receiver layer 64 coated on one surface of the PET sheet 62, a pressure/heat-sensitive color-developing layer 66P coated on the image-receiver layer 64, and a heat-sensitive color-developing layer 66T coated on the other surface of the PET sheet 62.

The image-receiver layer 64 is formed as a color developer layer. To produce the color developer layer 64, an aqueous compound G is prepared, composed as shown in the following table:

| COMPOSITIONS | PARTS BY WEIGHT |
|---|---|
| (1) 40 wt. % K-5 aqueous dispersion | 1.0 |
| (2) 20 wt. % PVA aqueous solution | 0.5 |

Herin:

The composition (1) is prepared by prepared by mixing 40 wt. % of K-5 (color developer) with purified water; and The composition (2) is prepared by dissolving 20 wt. % of polyvinyl alcohol (PVA) in purified water.

One surface of the PET sheet is coated with the aqueous compound G at about 3 to 5 g per square meter, using a No.10/Mayer-Bar, and then the coated layer is allowed to dry naturally, resulting in production of the image-receiver layer or color developer layer 64. Note, in FIG. 18, the color developer component is represented by symbol "×".

The produced image-receiver layer 64 exhibits white, due to the use of polyvinyl alcohol (PVA). In the fourth embodiment, since it is intended that a full color image is observed from the side of the heat-sensitive color developing layer 66T, it is unnecessary to form the image-receiver layer 64 as a translucent or transparent layer. Of course, if a full color image is observed from the side of the pressure/heat-sensitive color developing layer 66P, Gabusen ES-901A should be substituted for PVA.

The pressure/heat-sensitive color-developing layer 66P is essentially identical to the color-developing layer 54P of the third embodiment, and thus pressure-sensitive microcapsules 68 contained in the color-developing layer 66P are identical to the microcapsules 18 of the first embodiment. Namely, the color-developing layer 66P is produced in essentially the same manner as explained in the third embodiment. Note, Gabusen ES-901A may be substituted for PVA, because a full color image is observed from the side of the heat-sensitive color-developing layer 66T, as stated above.

The heat-sensitive color-developing layer 66T is also identical to the color-developing layer 54T except that Gabusen ES-901A is substituted for PVA. Of course, this is because a full color image is observed from the side of the color-developing layer 66T.

The pressure/heat-sensitive color developing layer 66P features essentially the same color developing characteristics as the color-developing layer 54P of the third embodiment (FIG. 16), and the heat-sensitive color-developing layer 66T also features essentially the same color developing characteristic as the color-developing layer 54P of the third embodiment. Thus, using the printer shown in FIG. 17, it is possible to form and record a full color image on the image-forming medium 60.

In the fourth embodiment, when magenta, blue and cyan images are formed on the pressure-sensitive color-developing layer 66P, these color images are infiltrated into the image-receiver layer or color developer layer 64, and thus can be observed from the side of the heat-sensitive color-developing layer 66T, whereby an observation of a full color image is possible by forming a yellow image on the color-developing layer 66T. Note, of course, each of the magenta, blue and cyan images must be formed as a mirror image on the color-developing layer 66P with respect to the yellow image formed on the color-developing layer 66T, before the full color image can be properly observed.

Figure 19:
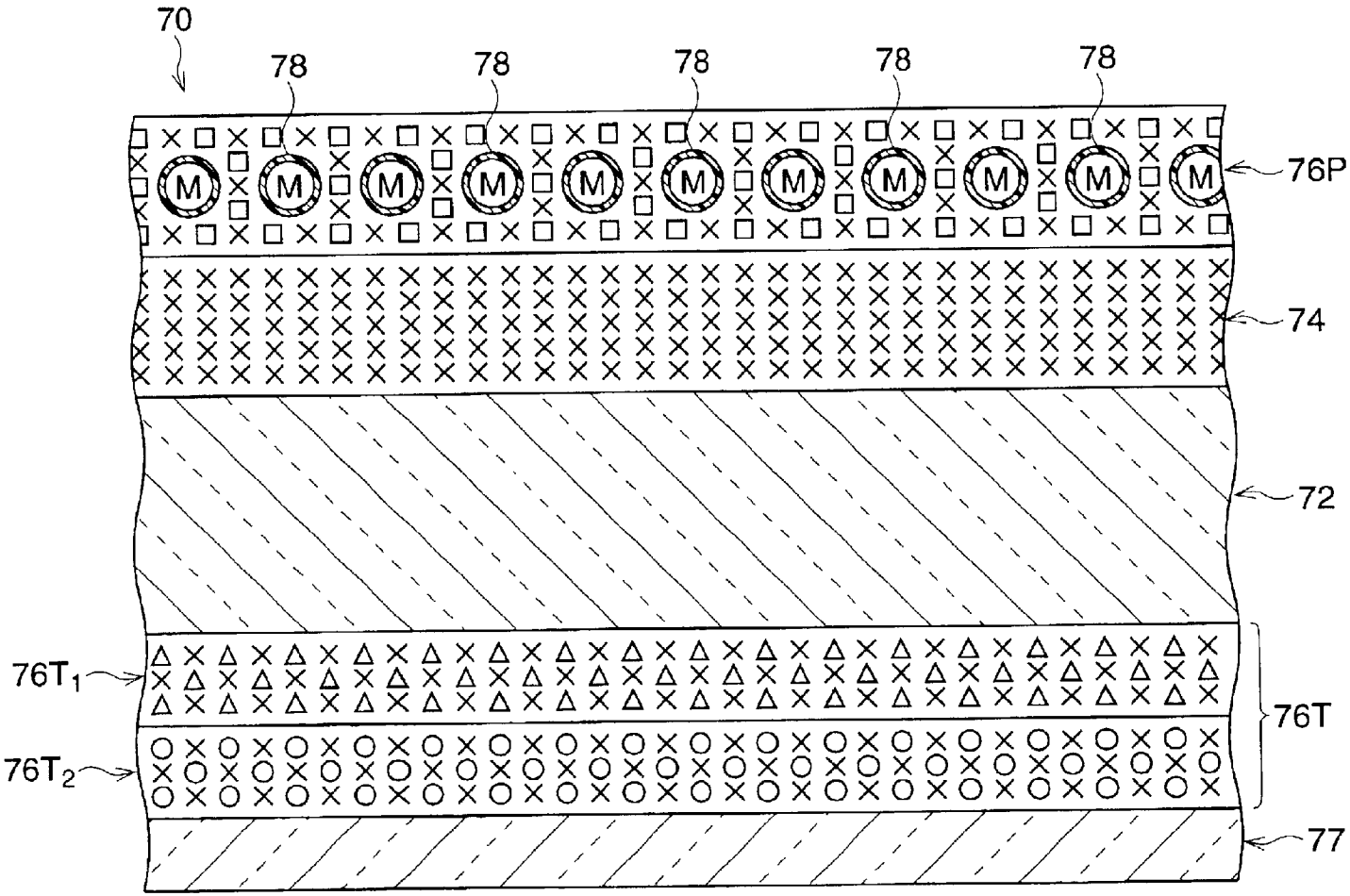
FIG. 19 is a schematic cross-sectional view showing a fifth embodiment of a color image-forming medium, according to the present invention.

FIG. 19 shows a fifth embodiment of a color-image-forming medium, generally indicated by reference numeral 70, according to the present invention, which is also constituted such that a full color image can be formed thereon. The image-forming medium 70 comprises a transparent polyethylene terephthalate (PET) sheet 72 having a thickness of about 100 $\mu$m, an image-receiver layer 74 coated on one surface of the PET sheet 72, a pressure/heat-sensitive color-developing layer 76P coated on the image-receiver layer 74, a heat-sensitive color-developing layer 76T coated on the other surface of the PET sheet 72, and a protective film sheet 77 applied to the color-developing layer 76T.

The respective PET sheet 72 and image-receive layer 74 are essentially identical to the PET sheet 62 and image-receive layer 64 of the fourth embodiment (FIG. 18). Also, the pressure/heat-sensitive color-developing layer 76P is essentially identical to the color-developing layer 54P of the third embodiment, and thus pressure-sensitive microcapsules 78 contained in the color-developing layer 76P are identical to the microcapsules 18 of the first embodiment.

As shown in FIG. 19, the heat-sensitive color-developing layer 76T is formed as a double-layer structure including a first heat-sensitive layer section 76$T_1$ and a second heat-sensitive layer section 76$T_2$. The first-sensitive layer section 76$T_1$ is formed as a heat-sensitive black-developing layer composed of a black-developing leuco-pigment component represented by symbols "Δ", and a color developer component represented by symbols "×". For the respective components "Δ" and "×", ETAC and K-5 are utilized. The second-sensitive layer section 76$T_2$ is formed as a heat-sensitive yellow-developing layer which is essentially identical to the transparent heat-sensitive color-developing layer 66T of the fourth embodiment.

The image-receiver layer or color developer layer 74 and the pressure/heat-sensitive color-developing layer 76P are produced in essentially the same manner as explained in the fourth embodiment.

To produce the heat-sensitive black-developing layer 76$T_1$, an aqueous compound H is prepared, composed as shown in the following table:

| COMPOSITIONS | PARTS BY WEIGHT |
|---|---|
| (1) 17 wt. % ETAC aqueous dispersion | 0.5 |
| (2) 16 wt. % K-5 aqueous dispersion | 1.0 |
| (3) 10 wt. % polyester aqueous solution | 1.0 |

Herein:

The composition (1) is prepared by mixing 17 wt. % of ETAC (black-developing leuco-pigment) with purified water;

The composition (2) is prepared by mixing 16 wt. % of K-5 (color developer) with purified water;

The composition (3) is prepared by dissolving 10 wt. % of Gabusen ES-901A (water-soluble polyester) in purified water.

The other surface of the PET sheet 72 is coated with the aqueous compound H at about 3 to 5 g per square meter, using a No.6/Mayer-Bar, and then the coated layer is allowed to dry naturally, resulting in production of the heat-sensitive black-developing layer 76$T_1$. As stated above, although ETAC (black-developing leuco-pigment) exhibits the color-developing temperature (208° C.), the color developing temperature is lowered to about 170° C. due to the existence of the color developer component (K-5) exhibiting the melting point of 145° C.

Successively, the heat-sensitive yellow-developing layer 76$T_2$ is formed on the heat-sensitive black-developing layer 76$T_1$ in substantially the same manner as explained in the fourth embodiment. Then, by adhering the protective film sheet 77 to the heat-sensitive yellow-developing layer 76T, the production of the image-forming medium 70 is completed. The protective film sheet 77 may be formed as a transparent film sheet of polyethylene terephthalate (PET) having a thickness of 6 $\mu$m, and can be thermally adhered to the color-developing layer 76$T_2$ by melting the color developer component "×" at a temperature of about 80 to 100° C., less than the color-developing temperature (140° C.) of the yellow-developing leuco-pigment "○".

Thus, the pressure/heat-sensitive color developing layer 76P features essentially the same color developing characteristics as the color-developing layer 54P of the third embodiment (FIG. 16). Thus, it is possible to form and record magenta, blue and cyan images on the color-developing layer 76P by the first thermal printing head 30$_1$ of the printer shown in FIG. 17.

On the other hand, the color developing characteristic of the heat-sensitive color-developing layer 76T is similar to that of a conventional heat-sensitive multi-color image-forming sheet. In particular, when a temperature more than the color developing temperature (140° C.) of the yellow-developing leuco-pigment "○" is exerted on the color-developing layer 76T, yellow is developed thereon, and when a temperature more than the color developing temperature (170° C.) of the black-developing leuco-pigment "Δ" is exerted on the color-developing layer 76T, black-is developed thereon. Note, of course, although yellow is also developed at the color developing temperature (170° C.) of the black-developing leuco-pigment "Δ", the developed yellow is absorbed by the black.

Thus, using the printer shown in FIG. 17, it is possible to form and record a full color image on the image-forming medium 70. Similar to the fourth embodiment, when magenta, blue and cyan images are formed on the pressure-sensitive color-developing layer 76P, these color images are infiltrated into the image-receiver layer or color developer layer 74, and thus can be observed from the side of the heat-sensitive color-developing layer 76T, whereby observation of a full color image is possible by forming yellow and black images on the color-developing layer 76T. Note, of course, each of the magenta, blue and cyan images must be formed as an mirror image on the color-developing layer 76P with respect to the yellow and black images formed on the color-developing layer 76T, before the full color image can be properly observed.

Figure 20:
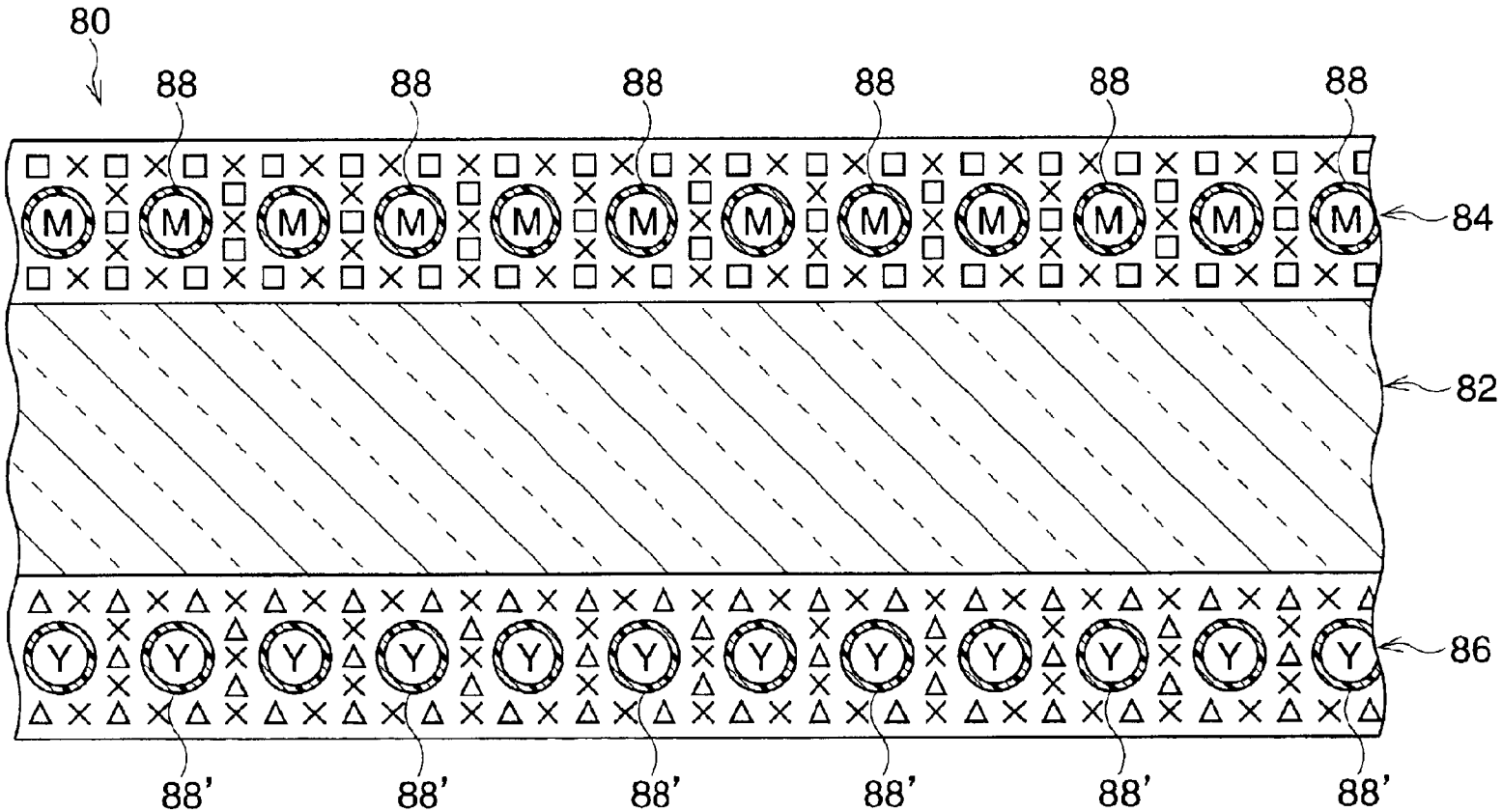
FIG. 20 is a schematic cross-sectional view showing a sixth embodiment of a color image-forming medium, according to the present invention.

FIG. 20 shows a sixth embodiment of a color-image-forming medium, generally indicated by reference numeral 80, according to the present invention, which is also constituted such that a full color image can be formed thereon. The image-forming medium 80 comprises a porous transparent polyethylene terephthalate (PET) sheet 82 having a thickness of about 100 μm, a first pressure/heat-sensitive color-developing layer 84 coated on one surface of the PET sheet 82, and a second pressure/heat-sensitive color-developing layer 86 coated on the other surface of the PET sheet 82.

The first pressure/heat-sensitive color-developing layer 84 is essentially identical to the color-developing layer 54P of the third embodiment, and thus pressure-sensitive microcapsules 88 contained in the color-developing layer 84 are identical to the microcapsules 18 of the first embodiment. Thus, the second pressure/heat-sensitive color developing layer 84 features essentially the same color developing characteristics as the color-developing layer 54P of the third embodiment (FIG. 16).

The second pressure/heat-sensitive color-developing layer 86 is constituted as a heat-sensitive color-developing layer containing a plurality of pressure-sensitive microcapsules 88' uniformly distributed therein, and the heat-sensitive color-developing layer is composed of a black-developing leuco-pigment component represented by symbols "Δ", and a color developer component represented by symbols "×". For the black-developing leuco-pigment component "Δ", ETAX is utilized, and for the color developer component "X", K-5 is utilized. Although not shown in FIG. 20, the second pressure/heat-sensitive color-developing layer 86 contains a suitable amount of stearic acid amide which serves as a sensitizer for regulating the color-developing temperature of the black-developing leuco-pigment component "Δ" and the melting point of the color developer component "×".

The pressure-sensitive microcapsules 88' are filled with a yellow ink or dye exhibiting a given tone. In this embodiment, the yellow dye is composed of a transparent liquid vehicle, and a yellow-developing leuco-pigment dissolved in the vehicle. For the liquid vehicle, KMC-113 is utilized, and for the yellow-developing leuco-pigment, I-3R is utilized. In short, the yellow dye is prepared by dissolving 4 g of I-3R in 100 g of KMC-113, and the microcapsules 88' are produced in substantially the same manner as the microcapsules 18. In FIG. 20, the yellow dye, contained in each pressure-sensitive microcapsule 88', is represented by the first capital letter "Y" of Yellow.

A shell wall of each pressure-sensitive microcapsule 88' is formed of a melamine resin exhibiting transparency. The microcapsules 88' have an average diameter of about 3 to 4 μm, and the shell wall of each microcapsule 88' has a thickness such that each microcapsule 88' is squashed and broken when being subjected to a pressure of higher than about 0.5 MPa, with a shearing force.

To produce the second pressure/heat-sensitive color-developing layer 86, an aqueous compound I is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % ETAC aqueous dispersion | 0.5 |
| (3) 16 wt. % K-5 aqueous dispersion | 1.0 |

-continued

| COMPOSITIONS | PARTS BY WEIGHT |
|---|---|
| (4) 16 wt. % stearic acid amide aqueous dispersion | 0.5 |
| (4) 20 wt. % polyester aqueous solution | 0.5 |

Herein:

The composition (1) is prepared by mixing 25 wt. % of the microcapsules 88' with purified water;

The composition (2) is prepared by mixing 17 wt. % of ETAC (black-developing leuco-pigment) with purified water;

The composition (3) is prepared by mixing 16 wt. % of K-5 (color-developer) with purified water;

The composition (3) is prepared by mixing 16 wt. % of stearic acid amide (sensitizer) with purified water; and The composition (4) by dissolving 20 wt. % of Gabusen ES-901A (water-soluble polyester) in purified water.

The other surface of the PET sheet 82 is coated with the aqueous compound I at about 4 to 5 g per square meter, using a No.8/Mayer-Bar, and then the coated layer is allowed to dry naturally, resulting in production of the second pressure/heat-sensitive color-developing layer 86.

Since the second pressure/heat-sensitive color-developing layer 86 contains stearic acid amide (sensitizer), the melting point of the color developer component (K-5) is lowered from 145° C. to about 90° C., and the color-developing temperature of the black-developing leuco-pigment (ETAC) is lowered to about 150° C.

Figure 21:
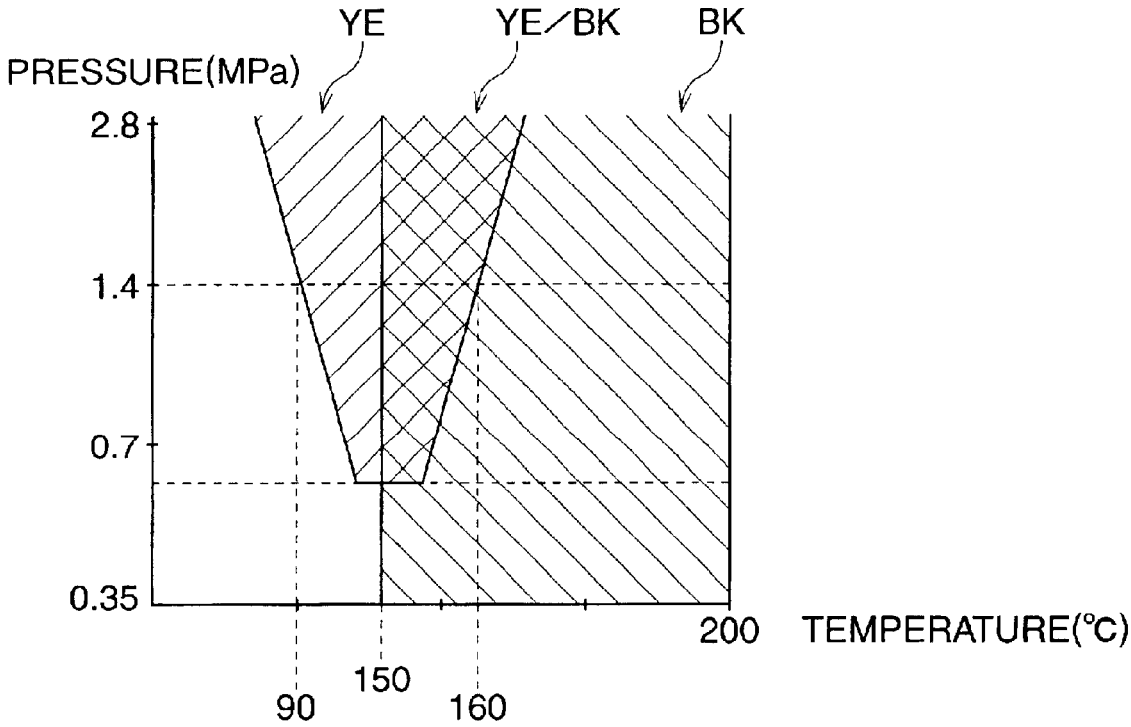
FIG. 21 is a graph illustrating color developing characteristics of a second pressure/heat-sensitive color-developing layer of the sixth embodiment shown in FIG. 20.

Referring to FIG. 21, color developing characteristics of the second pressure/heat-sensitive color-developing layer 86 is shown as a graph. In this graph, reference "YE" indicates a yellow-developing area, and reference "BK" indicates a black-developing area. At a cross-hatching area "MA/CY", overlapped by both the developing areas "YE" and "BK", although both yellow and black are developed, the developed yellow is absorbed by the black. When a pressure is 1.4 MPa, the yellow-developing area "YE" is defined as a temperature range between critical temperatures of 90° C. and 160° C., the black-developing area "BK" is defined as a temperature range more than a critical temperature of 150° C.

Although it is possible to form and record a full color image on the image-forming medium 80, using the printer as shown in FIG. 17, the second spring-biasing unit $\mathbf{34}_2$ must be set such that the second thermal printing head $\mathbf{30}_2$ is pressed against the second roller platen $\mathbf{32}_2$ at a pressure of 1.4 MPa.

In short, it is possible to form magenta, blue and cyan images on the first pressure/sensitive color-developing layer 84 by the first thermal printing head $\mathbf{30}_1$, and it is possible to form yellow and black images on the second pressure/sensitive color-developing layer 86 by the second thermal printing head $\mathbf{30}_2$. The formed color images are infiltrated into the PET sheet 82 due to the porosity thereof. Thus, a full color image can be observed from the side of the second heat-sensitive color-developing layer 86 formed as a transparent layer.

The present invention is further directed to a color-developing medium composed of a suitable sheet-like substrate (12, 42), and a pressure/heat-sensitive color developer layer (16P, 46P, 46P', 54P, 66P, 76P, 84, 86) formed on the substrate (12, 42, 52, 62, 72, 82) such that pressure-sensitive microcapsules (18,48) are not squashed and broken at more than a critical heating temperature, because such a color-developing medium can be advantageously utilized to constitute various types of color image-forming medium, as mentioned above.

Finally, it will be understood by those skilled in the art that the foregoing description is of preferred embodiments of the medium, and that various changes and modifications may be made to the present invention without departing from the spirit and scope thereof.

The disclosure relates to subject matters contained in Japanese Patent Applications No. 2000-133773 (filed on May 2, 2000), No. 2001-099132 (filed on Mar. 30, 2001) and No. 2001-104428 (filed on Apr. 3, 2001) which are expressly incorporated herein, by reference, in their entireties.

What is claimed is:

1. A color image-forming medium comprising:

a substrate; and a color-developing layer coated on said substrate, wherein said color-developing layer is composed of at least one kind of heat-sensitive color-developing component, and a plurality of pressure-sensitive microcapsules uniformly distributed therein;

each of said pressure-sensitive microcapsules is filled with a material corresponding to a first single-color, and features a pressure/temperature characteristic to be broken when being subjected to a predetermined pressure within a first temperature range; and said heat-sensitive color-developing component features a thermal color-developing characteristic to develop a second single color within a second temperature range defined by a first critical temperature and a second critical temperature, said first critical temperature being in said first temperature range, said second critical temperature exceeding an upper limit temperature of said first temperature range.

2. A color image-forming medium as set forth in claim 1, wherein a temperature range between the first critical temperature of said second temperature range and the upper limit temperature of said first temperature range is defined as a color developing range in which both said first single color and said second single color are developed.

3. A color image-forming medium as set forth in claim 1, wherein a temperature range between the upper limit temperature of said first temperature range and the second critical temperature of said second temperature range is defined as a color developing range in which only said second single color is developed.

4. A color image-forming medium as set forth in claim 1, wherein an extent of said first temperature range is regulated by varying at least one parameter selected from the group consisting of a thickness of the color-developing layer, an amount of filler contained in the color-developing layer, an average diameter of the pressure-sensitive microcapsules, a material of the substrate, a shell wall strength of the pressure-sensitive microcapsules, and a surface roughness of the substrate.

5. A color image-forming medium as set forth in claim 1, wherein a lower limit temperature of said first temperature range is set as a temperature of less than 100° C.

6. A color image-forming medium as set forth in claim 1, wherein said color developing layer is further composed of another kind of heat-sensitive color-developing component featuring a thermal color-developing characteristic to develop a third single color within a third temperature range more than said second critical temperature.

7. A color image-forming medium as set forth in claim 6, wherein each of said heat-sensitive color-developing components comprises a leuco-compound, and said color developing layer is composed of a color developer component for said leuco-compound.

8. A color image-forming medium as set forth in claim 7, wherein said first critical temperature is defined as a critical color-developing temperature of the leuco-compound exhibiting the thermal color developing characteristic defined by said second temperature range, and said second critical temperature is defined as a critical color-developing temperature of the leuco-compound exhibiting the thermal color developing characteristic defined by said third temperature range.

9. A color image-forming medium as set forth in claim 7, wherein the leuco-compound, exhibiting the thermal color developing characteristic defined by said third temperature range, comprises a black-developing leuco-compound.

10. A color image-forming medium as set forth in claim 7, wherein the material, encapsulated in said pressure-sensitive microcapsules, is based on a leuco-compound, and said color developer component is thermally fused when being subjected to at least a lower limit temperature of said first temperature range.

11. A color image-forming medium as set forth in claim 1, wherein said color developing layer is formed as a double-layer structure including a pressure/heat-sensitive color-developing layer containing said pressure-sensitive microcapsules and a heat-sensitive color-developing layer composed of said heat-sensitive color developing component.

12. A color image-forming medium as set forth in claim 11, wherein the material, encapsulated in said pressure-sensitive microcapsules, is based on a leuco-compound, and said pressure/heat-sensitive color-developing layer is composed of a color developer component for said leuco-compound, said color developer component being thermally fused when being subjected to at least a lower limit temperature of said first temperature range.

13. A color image-forming medium as set forth in claim 11, wherein said pressure/heat-sensitive color developing layer is further composed of another kind of heat-sensitive color-developing component featuring a thermal color-developing characteristic to develop a third single color within a third temperature range more than said second critical temperature.

14. A color image-forming medium as set forth in claim 13, wherein each of said heat-sensitive color-developing component5 comprises a leuco-compound, and each of said pressure/heat-sensitive color developing layer and said heat-sensitive color developing layer is composed of a color developer component for said leuco-compound.

15. A color image-forming medium as set forth in claim 14, wherein the leuco-compound contained in said pressure/heat-sensitive color-developing layer comprises a black-developing leuco-compound.

16. A color image-forming medium as set forth in claim 13, wherein said first critical temperature is defined as a critical color-developing temperature of the leuco-compound contained in the heat-sensitive color-developing layer, and said second critical temperature is defined as a critical color-developing temperature of the leuco-pigment contained in the pressure/heat-sensitive color-developing layer.

17. A color developing medium comprising:

a substrate; and a pressure/heat-sensitive color-developing layer coated on said substrate, wherein said pressure/beat-sensitive color-developing layer is formed as a binder layer containing a plurality of pressure-sensitive microcapsules uniformly distributed therein;

each of said pressure-sensitive microcapsules is filled with a material corresponding to a given single-color, and features a pressure/temperature characteristic to be broken when being subjected to a predetermined pressure within a predetermined temperature range; and an extent of said predetermined temperature range is regulated by varying at least one parameter selected from the group consisting of a thickness of the pressure/heat-sensitive color-developing layer, an amount of filler contained in the pressure/heat-sensitive color-developing layer, an average diameter of the pressure-sensitive microcapsules, a material of the substrate, a shell wall strength of the pressure-sensitive microcapsules and a surface roughness of the substrate.

18. A color image-forming medium s set forth in claim 17, wherein the material, encapsulated in said pressure-sensitive microcapsules, is based on a leuco-compound, and said binder layer is formed as a color developer layer composed of a color developer component for said leuco-compound, said color developer component being thermally fused when being subjected to at least a lower limit temperature of said predetermined temperature range.

19. A color image-Conning medium as set forth in claim 18, wherein said binder layer is configured to melt at a critical temperature.

20. A color image-forming medium as set forth in claim 18, wherein each of said pressure-sensitive microcapsules are not broken when subjected to the predetermined pressure outside of said predetermined temperature range.

21. A color developing medium as sot forth in claim 17, wherein said binder layer is configured to melt at a critical temperature.

22. A color developing medium as set forth in claim 17, wherein each of said pressure-sensitive microcapsules are not broken when subjected to the predetermined pressure outside of said predetermined temperature range.

* * * * *